US008440377B2

(12) United States Patent
Ozawa et al.

(10) Patent No.: US 8,440,377 B2
(45) Date of Patent: May 14, 2013

(54) ELECTROPHOTOGRAPHIC PHOTOSENSITIVE MEMBER AND ELECTROPHOTOGRAPHIC APPARATUS

(75) Inventors: Tomohito Ozawa, Mishima (JP); Motoya Yamada, Suntou-gun (JP); Kazuyoshi Akiyama, Mishima (JP); Daisuke Tazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 12/949,053

(22) Filed: Nov. 18, 2010

(65) Prior Publication Data

US 2011/0123915 A1 May 26, 2011

(30) Foreign Application Priority Data

Nov. 26, 2009 (JP) ..... 2009-269346
Nov. 15, 2010 (JP) ..... 2010-254811

(51) Int. Cl.
*G03G 5/043* (2006.01)

(52) U.S. Cl.
USPC ..... 430/59.1; 430/56; 430/66

(58) Field of Classification Search ..... 430/58.5–59.6
See application file for complete search history.

(56) References Cited

U.S. PATENT DOCUMENTS 4,569,855 A 2/1986 Matsuda et al.
4,683,144 A 7/1987 Nishimura et al.
4,683,145 A 7/1987 Nishimura et al.
4,683,146 A 7/1987 Hirai et al.
4,683,147 A 7/1987 Eguchi et al.
5,112,709 A 5/1992 Yamazaki et al.
5,392,098 A 2/1995 Ehara et al.
5,455,138 A 10/1995 Okamura et al.
5,480,750 A 1/1996 Kawada et al.
5,582,944 A 12/1996 Yamamura et al.
5,817,181 A 10/1998 Okamura et al.
5,849,446 A 12/1998 Hashizume et al.
5,976,745 A 11/1999 Aoki et al.
6,183,930 B1 2/2001 Ueda et al.
6,238,832 B1 5/2001 Hashizume et al.

(Continued)

FOREIGN PATENT DOCUMENTS

JP 58-080656 A 5/1983
JP 04-093864 A 3/1992

(Continued)

*Primary Examiner* — Mark F Huff
*Assistant Examiner* — Rashid Alam
(74) *Attorney, Agent, or Firm* — Fitzpatrick, Cella, Harper & Scinto

(57) ABSTRACT

An electrophotographic photosensitive member includes a substrate, a photoconductive layer, an intermediate layer, and a surface layer sequentially formed. The intermediate layer contains silicon, carbon and hydrogen, and a distribution of a hydrogen ratio, which is a ratio of the number of hydrogen atoms to the number of silicon, carbon and hydrogen atoms, in the intermediate layer has a maximum region. A largest hydrogen atomic ratio in the intermediate layer is larger than a hydrogen atomic ratio in the surface layer, and the hydrogen atomic ratio in the surface layer is 0.30 to 0.45. A distribution of a carbon atomic ratio, which is a ratio of the number of carbon atoms to the number of silicon and carbon atoms, in the intermediate layer has a maximum and a minimum region. A carbon atomic ratio in the maximum region is 0.53 to 0.63, a carbon atomic ratio in the minimum region is 0.47 or more, and the maximum hydrogen region in the intermediate layer is partially superimposed on the minimum carbon region.

8 Claims, 6 Drawing Sheets

U.S. PATENT DOCUMENTS

| | | | | |
|---|---|---|---|---|
| 6,322,943 | B1 | 11/2001 | Aoki et al. | |
| 7,157,197 | B2 | 1/2007 | Aoki et al. | |
| 7,255,969 | B2 | 8/2007 | Kojima et al. | |
| 7,498,110 | B2 | 3/2009 | Taniguchi et al. | |
| 2010/0021835 | A1 | 1/2010 | Akiyama et al. | |
| 2010/0021836 | A1 * | 1/2010 | Ozawa et al. | 430/66 |
| 2010/0021837 | A1 | 1/2010 | Ozawa et al. | |

FOREIGN PATENT DOCUMENTS

| | | | |
|---|---|---|---|
| JP | 05-018471 | A | 1/1993 |
| JP | 06-102686 | A | 4/1994 |
| JP | 06-250425 | A | 9/1994 |
| JP | 07-043921 | A | 2/1995 |
| JP | 07-175244 | A | 7/1995 |
| JP | 08-022229 | A | 1/1996 |
| JP | 11-161120 | A | 6/1999 |
| JP | 2000-003055 | A | 1/2000 |
| JP | 03-124841 | A | 1/2001 |
| JP | 2002-123020 | A | 4/2002 |
| JP | 2002-148907 | A | 5/2002 |
| JP | 2002-229303 | A | 8/2002 |
| JP | 2002-296987 | A | 10/2002 |
| JP | 2003-107766 | A | 4/2003 |
| JP | 2003-107767 | A | 4/2003 |
| JP | 2003-337437 | A | 11/2003 |
| JP | 2004-077650 | A | 3/2004 |
| JP | 2004-126347 | A | 4/2004 |
| JP | 2004-133397 | A | 4/2004 |

* cited by examiner

ELECTROPHOTOGRAPHIC PHOTOSENSITIVE MEMBER AND ELECTROPHOTOGRAPHIC APPARATUS

BACKGROUND OF THE INVENTION

1. Field of the Invention

The present invention relates to an electrophotographic photosensitive member and an electrophotographic apparatus. The present invention particularly relates to an electrophotographic photosensitive member having an intermediate layer and a surface layer (hereinafter, the intermediate layer including aa-SiC will be also described as "aa-SiC intermediate layer", and the surface layer including aa-SiC will be also described as "aa-SiC surface layer") including hydrogenated amorphous silicon carbide (hereinafter, also described as "aa-SiC"), and an electrophotographic apparatus having the electrophotographic photosensitive member.

2. Description of the Related Art

An electrophotographic photosensitive member having a photoconductive layer (photosensitive layer), which includes an amorphous material, on a substrate (conductive substrate) is widely known. In particular, electrophotographic photosensitive members having photoconductive layers of amorphous silicon (hereinafter, also described as "a-Si") formed on substrates of metals by layer forming techniques such as a chemical vapor deposition method (CVD method) and a physical vapor deposition method (PVD method) have been already commercialized. Hereinafter, a photoconductive layer including a-Si will be also described as an "a-Si photoconductive layer", and an electrophotographic photosensitive member having the a-Si photoconductive layer will be also described as an "a-Si photosensitive member". As a basic constitution of such an a-Si photosensitive member, a positively chargeable a-Si photosensitive member 5000 as illustrated in FIG. 5B is known. The positively chargeable a-Si photosensitive member 5000 has a constitution in which a photoreceptive layer 5002 including a-Si is formed on a conductive substrate 5001, and an aa-SiC surface layer 5005 is further formed on the photoreceptive layer 5002.

Further, as shown in FIG. 5A, providing an intermediate layer 5006 between a photoconductive layer 5004 on a charge injection inhibition layer 5003 and the aa-SiC surface layer 5005 is known. Further, it is known that the photosensitive characteristics are improved by controlling the content of the atoms forming the photoconductive layer 5004 or the aa-SiC surface layer 5005 in the region in the vicinity of the interface between the photoconductive layer 5004 and the aa-SiC surface layer 5005. Japanese Patent Application Laid-Open No. H07-175244 discloses the art of producing an a-Si photosensitive member so that the content of hydrogen atoms in the vicinity of the interface between the photoconductive layer and the surface layer is larger than the content of the hydrogen atoms of any one of the photoconductive layer and the surface layer in the a-Si photosensitive member made by forming the a-Si photoconductive layer and the aa-SiC surface layer on the substrate. Like this, by forming the region having a high content of hydrogen atoms in the vicinity of the interface between the photoconductive layer and the surface layer, an a-Si photosensitive member excellent in photosensitivity can be produced.

Further, Japanese Patent Application Laid-Open No. 2002-123020 discloses the art of producing a negatively chargeable electrophotographic photosensitive member having the maximum value in the distribution in a layer thickness direction (stacking direction) of the content percentage of the carbon atoms in the surface layer, in the a-Si photosensitive member made by forming an a-Si photoconductive layer and an aa-SiC surface layer on a substrate. In Japanese Patent Application Laid-Open No. 2002-123020, the electrophotographic photosensitive member excellent in charging performance at the time of negatively charging, sensitivity, optical memory and image deletion can be produced by making the content percentage of carbon atoms nonuniform in the layer thickness direction so as to have a peak region in which the content percentage of carbon atoms in the surface layer is 85 to 95 atomic %. Further, Japanese Patent Application Laid-Open No. 2004-133397 discloses the art of producing an electrophotographic photosensitive member having two or more maximum values in the distribution in the layer thickness direction of the content percentage of the carbon atoms in the surface layer in the a-Si photosensitive member made by forming an a-Si photoconductive layer and an aa-SiC surface layer on a substrate. Japanese Patent Application Laid-Open No. 2004-133397 also discloses the art of producing an electrophotographic photosensitive member in which the content percentage of the elements belonging to the $13^{th}$ group of the periodic table in the surface layer also has the maximum value in the distribution in the layer thickness direction. In Japanese Patent Application Laid-Open No. 2004-133397, the electrophotographic photosensitive member excellent in photosensitive characteristics with less image defection can be produced by alternately distributing the maximum value of the content percentage of the carbon atoms and the maximum value of the content percentage of the elements belonging to the $13^{th}$ group of the periodic table in the surface layer in the layer thickness direction.

In recent years, in the market, speedup and colorization of electrophotographic apparatuses have proceeded, and the electrophotographic process is changed to the one that is easily worn as compared with the conventional apparatus. To these market requests, improvement in the electrophotographic apparatuses is necessary, and the electrophotographic photosensitive members are needed, which can realize longer lives while keeping favorable photosensitive characteristics at the same time. In order to increase the life in an electrophotographic photosensitive member, it is necessary to increase the thickness of the aa-SiC surface layer, or enhance the hardness of the aa-SiC surface layer itself while keeping favorable photosensitive characteristics. However, when the surface layer is formed on the photoconductive layer to be thick, if a sudden environmental change (sudden change in temperature and humidity) occurs, separation sometimes occurs in the vicinity of the interface between the photoconductive layer and the aa-SiC surface layer. As one example of the sudden environmental change, transportation of electrophotographic photosensitive members by aircraft is cited.

The separation which occurs in the vicinity of the interface between the photoconductive layer and the aa-SiC surface layer is considered to be caused because the internal stress of the surface layer itself becomes larger as the layer thickness of the a-Sic surface layer is made larger. The reason for this is considered to be that as the thickness of the aa-SiC surface layer becomes larger, the difference in the internal stress between the photoconductive layer and the aa-SiC surface layer becomes larger, and therefore, stress concentrates in the vicinity of the interface between the photoconductive layer and the aa-SiC surface layer. Further, enhancement of the hardness of the aa-SiC surface layer itself can be achieved by adopting an aa-SiC surface layer denser than the conventional one. However, when a dense aa-SiC surface layer is formed on the photoconductive layer, if a sudden environmental change occurs, separation sometimes occurs in the vicinity of the interface between the photoconductive layer and the aa- SiC surface layer, as in the case of increase of the thickness of the aa-SiC surface layer. The cause of separation which occurs in the vicinity of the interface between the photoconductive layer and the aa-SiC surface layer is the same as in the case of increase of the thickness of the aa-SiC surface layer. More specifically, this is considered to be because the internal stress of the aa-SiC surface layer itself becomes larger, as the aa-SiC surface layer is made denser, and therefore, the stress concentrates in the vicinity of the interface between the photoconductive layer and the aa-SiC surface layer.

From the above, it is a difficult problem to keep favorable adhesion of the photoconductive layer and the aa-SiC surface layer when a sudden environmental change occurs, in case that the aa-SiC surface layer with high internal stress is formed on the photoconductive layer in the conventional electrophotographic photosensitive member.

SUMMARY OF THE INVENTION

An object of the present invention is to provide a long-life electrophotographic photosensitive member which realizes favorable adhesion even when a sudden environmental change occurs while keeping favorable photosensitive characteristics, even when an aa-SiC surface layer with high internal stress is formed on a photoconductive layer.

The present inventors firstly studied enhancement in adhesion of the aa-SiC surface layer with high internal stress for the purpose of increasing the lives of electrophotographic photosensitive members. As a result, the present inventors has found out that favorable adhesion can be obtained even in the surface layer with high internal stress by providing an intermediate layer between the photoconductive layer and the aa-SiC surface layer, and by forming a region with a high hydrogen atomic ratio (defined by the ratio (H/(Si+C+H)) of the number of hydrogen atoms (H) to the sum of the number of silicon atoms (Si), the number of carbon atoms (C) and the number of hydrogen atoms (H)) on the surface layer side of the intermediate layer. The present inventors assume the reason of improvement in adhesion by forming the region with a high hydrogen atomic ratio on the surface layer side of the intermediate layer is as described as follows. First, if a large number of hydrogen atoms are contained in the aa-SiC intermediate layer, the hydrogen atoms are bonded to the dangling bonds existing in the aa-SiC, and thereby, the degree of freedom of bonds between the respective atoms forming the aa-SiC is increased. Therefore, it is assumed that even if high stress is received from the surface layer, the region with a high hydrogen atomic ratio in the intermediate layer can relieve the high stress received from the surface layer. Therefore, concentration of local stress can be suppressed by forming the region with a high hydrogen atomic ratio in the region of the intermediate layer near the surface layer, and favorable adhesion is provided. However, it has been found out that if the region containing a large number of hydrogen atoms is formed in the intermediate layer, when an image is output with the electrophotographic apparatus, the characters on the output image sometimes become thin. Thus, the present inventors made earnest study to realize coexistence of improvement in adhesion and favorable photosensitive characteristics. As a result, it has been found out that the resistance in the region containing a large number of hydrogen atoms which is formed in the intermediate layer becomes high. It is assumed that as a result, the electric charges generated by image exposure are restrained from transferring in the layer thickness direction in the high-resistance region, and the electric charges diffuse in the vertical direction with respect to the layer thickness direction in the high-resistance region, which makes the characters on the output image thin. From this, the present inventors have found out that control of the resistance in the region with a high hydrogen atomic ratio in the intermediate layer is necessary, and made study concerning the resistance control in the region with a high hydrogen atomic ratio in the intermediate layer. As a result, the present inventors have found out that by reducing the carbon atomic content in the intermediate layer in the region with a high hydrogen atomic ratio in the intermediate layer, the resistance in the region with a high hydrogen atomic ratio in the intermediate layer can be reduced.

However, it has been found out that by reducing the carbon atomic content outside the region with a high hydrogen atomic ratio in the intermediate layer, the characters on the output image sometimes become thin when the image is output with the electrophotographic apparatus. Thus, the present inventors made study in order to realize further improvement in the photosensitive characteristics. As a result, the present inventors have found out that by reducing the carbon atomic ratio of the intermediate layer in the region with a high hydrogen ratio of the intermediate layer, in more detail, by making the region with a high hydrogen atomic ratio the minimum region of the distribution in the layer thickness direction of the carbon atomic ratio, the resistance in the region with a high hydrogen atomic ratio in the intermediate layer can be reduced, and coexistence of enhancement in adhesion and favorable photosensitive characteristics is possible.

Meanwhile, in the intermediate layer, by continuously increasing the carbon atomic ratio from the photoconductive layer side to the surface layer side, interference at the time of image exposure irradiation can be reduced. From this, the region with a high hydrogen atomic ratio for the purpose of enhancement of adhesion of the aa-SiC surface layer is formed on the surface layer side of the intermediate layer. Further, in order to obtain favorable photosensitive characteristics, the carbon atomic ratio in the region with a high hydrogen atomic ratio is reduced. In the intermediate layer outside the region with a high hydrogen atomic ratio, the conventional distribution in the layer thickness direction (layer stacking direction) of the carbon atomic ratio in which the carbon atomic ratio is continuously increased, for the purpose of reducing interference, is combined. Thereby, the maximum region is formed in the distribution in the layer thickness direction of the hydrogen atomic ratio in the intermediate layer, and with the maximum region of the distribution in the layer thickness direction of the hydrogen atomic ratio, the minimum region is formed in the distribution in the layer thickness direction of the carbon atomic ratio in the intermediate layer. As a result, the maximum region of the distribution in the layer thickness direction of the carbon atomic ratio is formed at the photoconductor layer side from the maximum region of the distribution in the layer thickness direction of the hydrogen atomic ratio in the intermediate layer. The inventors have found out that by forming such distributions in the layer thickness direction of the carbon atomic ratio and the hydrogen atomic ratio in the intermediate layer, coexistence of enhancement in adhesion of the aa-SiC surface layer and favorable photosensitive characteristics is enabled, and a large effect is obtained for the aforementioned problem, and have completed the present invention.

More specifically, the present invention is an electrophotographic photosensitive member comprising a substrate, a photoconductive layer on the substrate, an intermediate layer on the photoconductive layer and a surface layer formed from hydrogenated amorphous silicon carbide on the intermediate layer, wherein the intermediate layer contains silicon atoms, carbon atoms and hydrogen atoms, a distribution of a hydrogen atomic ratio which is defined by a ratio (H/(Si+C+H)) of the number of hydrogen atoms (H) to a sum of the number of silicon atoms (Si), the number of carbon atoms (C) and the number of hydrogen atoms (H) in the intermediate layer has a maximum region in a layer thickness direction of the intermediate layer, a largest value of the hydrogen atomic ratio in the maximum region of the distribution of the hydrogen atomic ratio in the intermediate layer is larger than a hydrogen atomic ratio in the surface layer, the hydrogen atomic ratio in the surface layer is 0.30 to 0.45 inclusive, a distribution of a carbon atomic ratio which is defined by a ratio (C/(Si+C)) of the number of carbon atoms (C) to a sum of the number of silicon atoms (Si) and the number of carbon atoms (C) in the intermediate layer has a maximum region and a minimum region in the layer thickness direction of the intermediate layer, a carbon atomic ratio in the maximum region of the distribution of the carbon atomic ratio in the intermediate layer is 0.53 to 0.63 inclusive, a carbon atomic ratio in the minimum region of the distribution of the carbon atomic ratio in the intermediate layer is 0.47 or more, and is smaller than the carbon atomic ratio in the maximum region of the distribution of the carbon atomic ratio in the intermediate layer, and at least a part of the maximum region of the hydrogen atomic ratio in the intermediate layer is superimposed on the minimum region of the carbon atomic ratio in the intermediate layer. Further, the present invention is an electrophotographic apparatus comprising the above described electrophotographic photosensitive member.

According to the present invention, a long-life electrophotographic photosensitive member can be provided, which realizes favorable adhesion even if a sudden environmental change occurs, while maintaining favorable photosensitive characteristics.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. Hereinafter, embodiments of the present invention will be described in detail by using the drawings.

(Intermediate Layer)

In the present invention, an intermediate layer refers to all layers formed between a photoconductor layer and an aa-SiC surface layer (surface layer including hydrogenated amorphous silicon carbide). The intermediate layer may include a plurality of layers. The boundary between the photoconductive layer and the intermediate layer is set as the position where carbon atoms are actually detected in a region from the photoconductive layer to the intermediate layer in the distribution in the layer thickness direction of a carbon atomic ratio (defined by the ratio (C/(Si+C)) of the number of carbon atoms (C) to the sum of the number of silicon atoms (Si) and the number of carbon atoms (C)). Next, the boundary between the surface layer and the intermediate layer will be shown below. When the carbon atomic ratio of the surface layer is constant, the position where the change rate of the carbon atomic ratio per layer thickness becomes negative in the change in the layer thickness direction of the carbon atomic ratio from the surface side to the substrate direction of the electrophotographic photosensitive member is set as the boundary between the intermediate layer and the surface layer. When the carbon atomic ratio of the surface layer continuously changes in the layer thickness direction, the condition of existence closest to the surface layer side among the boundary conditions shown in the below is set as the boundary between the intermediate layer and the surface layer. The first boundary condition is the position where the change in the change rate of the carbon atomic ratio per layer thickness becomes negative in the change in the layer thickness direction of the carbon atomic ratio from the surface side toward the substrate direction of the electrophotographic photosensitive member. The second boundary condition is the position which is located at the photoconductive layer side from the surface of the electrophotographic photosensitive member, and has the carbon atomic ratio of 0.61. However, when the carbon atomic ratio of the surface layer decreases continuously and linearly from the surface of the electrophotographic photosensitive member, the position which is located at the photoconductive layer side from the surface of electrophotographic photosensitive member and has the carbon atomic ratio of 0.61 is set as the boundary between the intermediate layer and the surface layer.

Figure 1A:
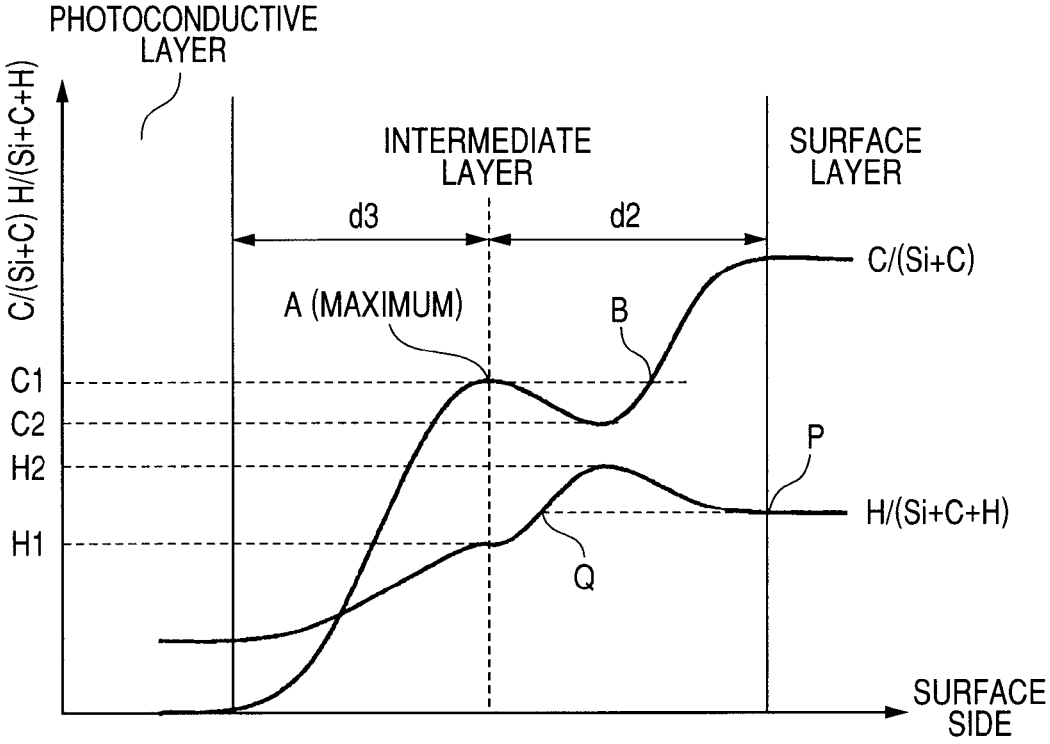
FIG. 1A is a diagram illustrating distributions in a layer thickness direction of a carbon atomic ratio and a hydrogen atomic ratio in an intermediate layer.
Figure 1B:
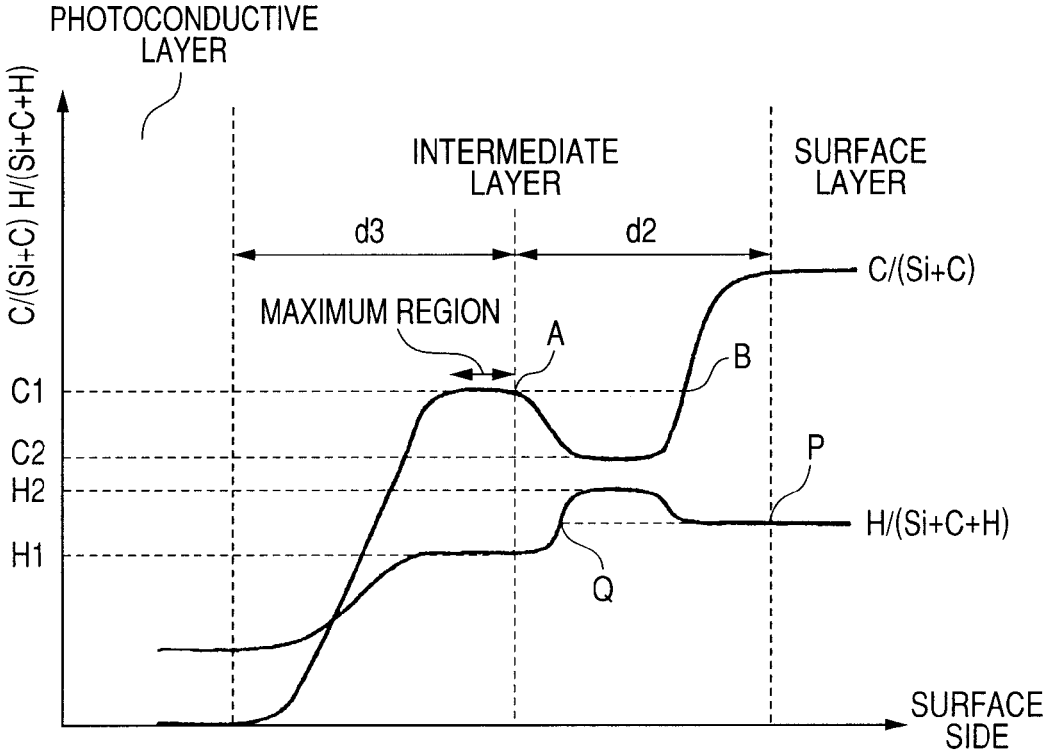
FIG. 1B is a diagram illustrating the distributions in the layer thickness direction of the carbon atomic ratio and the hydrogen atomic ratio in the intermediate layer.

FIGS. 1A and 1B illustrate the distributions in the layer thickness direction of the carbon atomic ratio and the hydrogen atomic ratio (defined by the ratio (H/(Si+C+H)) of the number of hydrogen atoms (H) to the sum of the number of silicon atoms (Si), the number of carbon atoms (C) and the number of hydrogen atoms (H)) in the intermediate layer according to the present invention. FIG. 1A illustrates the distributions in the layer thickness directions of the carbon atomic ratio and the hydrogen atomic ratio when a constant layer does not exist in the intermediate layer, or the region of the constant layer is extremely small. FIG. 1B illustrates the distributions in the layer thickness direction of the carbon atomic ratio and the hydrogen atomic ratio when the region of the constant layer in the intermediate layer is large. In the present invention, the distribution of the hydrogen atomic ratio has the maximum region in the distribution of the hydrogen atomic ratio distributed ununiformly in the layer thickness direction of the intermediate layer as illustrated in FIGS. 1A and 1B, and the largest value of the hydrogen atomic ratio in the maximum region of the distribution of the hydrogen atomic ratio in the intermediate layer is larger than the hydrogen atomic ratio in the surface layer. Further, the distribution of the carbon atomic ratio has the maximum region and the minimum region in the distribution of the carbon atomic ratio distributed ununiformly in the layer thickness direction of the intermediate layer, and at least a part of the maximum region of the hydrogen atomic ratio in the intermediate layer is superimposed on the minimum region of the carbon atomic ratio in the intermediate layer.

The maximum region of the carbon atomic ratio in the intermediate layer will be described by using FIGS. 1A and 1B. In the case of the distribution in the layer thickness direction of the carbon atomic ratio as illustrated in FIG. 1A, the location of the maximum value of the distribution of the carbon atomic ratio in the intermediate layer becomes the maximum region. Further, when the location showing the maximum value of the distribution of the carbon atomic ratio in the intermediate layer as shown in FIG. 1B has a width in the layer thickness direction, this region is the maximum region.

The minimum region of the carbon atomic ratio in the intermediate layer will be described by using FIGS. 1A and 1B. In the case of the distribution in the layer thickness direction of the carbon atomic ratio as illustrated in FIG. 1A, the position of the maximum value of the distribution of the carbon atomic ratio in the intermediate layer is set as a position A. When the position which is located at the surface layer side from the position A, and has the carbon atomic ratio of the same value as the position A is set as a position B, the region between the position A and the position B is the minimum region of the distribution of the carbon atomic ratio. Further, when the maximum region of the distribution of the carbon atomic ratio in the intermediate layer as illustrated in FIG. 1B is formed, the position which is the closest to the surface layer side of the maximum region of the distribution of the carbon atomic ratio is set as the position A. When the position which is located at the surface layer side from the position A, and has the carbon atomic ratio of the same value as the position A is set as the position B, the region between the position A and the position B is the minimum region of the distribution of the carbon atomic ratio.

The maximum region of the hydrogen atomic ratio in the intermediate layer will be described by using FIGS. 1A and 1B. When the hydrogen atomic ratio of the surface layer is constant, the position which is the closest to the photoconductive layer side in the distribution of the hydrogen atomic ratio in the surface layer is set as a position P. When the position which has the hydrogen atomic ratio of the same value as the position P, and is the closest to the photoconductive layer side is set as a position Q, the region between the position P and the position Q is the maximum region of the distribution of the hydrogen atomic ratio. When the hydrogen atomic ratio of the surface layer is not constant, the position with the largest value of the distribution of the hydrogen atomic ratio in the surface layer is set as the position P. When the position which has the hydrogen atomic ratio of the same value as the position P, and is the closest to the photoconductive layer side is set as the position Q, the region between the position P and the position Q is the maximum region of the distribution of the hydrogen atomic ratio. By setting the distributions of the hydrogen atomic ratio and the carbon atomic ratio in the intermediate layer as the aforementioned distributions, favorable adhesion can be obtained while the photosensitive characteristics are maintained, even when a sudden environmental change occurs. The reasons of this will be shown as follows.

First, it is conceivable that by setting Si and C forming the backbone of the aa-SiC structure, namely, the carbon atomic ratio to be constant in the aa-SiC, and increasing the hydrogen atomic ratio in the aa-SiC, the bond distance between the atoms forming the backbone can greatly change when receiving external force. This is considered to be caused by increase in the degree of freedom of bonding between the respective atoms forming the aa-SiC as a result that the hydrogen atoms are bonded to the dangling bonds existing in the aa-SiC. From this, it is conceivable that the aa-SiC with a high hydrogen atomic ratio can absorb more external force as compared with the aa-SiC with a low hydrogen atomic ratio.

The cause of separation of the surface layer is considered to be large stress received by the intermediate layer located between the photoconductive layer and the aa-SiC surface layer from the surface layer. Therefore, in order to absorb the stress received from the surface layer by the intermediate layer, a part of the intermediate layer needs to have the region with a hydrogen atomic ratio higher than the hydrogen atomic ratio of the surface layer. It is conceivable that thereby, the stress received from the surface layer can be relieved in the region with a high hydrogen atomic ratio of the intermediate layer, and therefore, a large effect can be obtained in suppression of removal of the surface layer.

Meanwhile, when the hydrogen atomic ratio in the aa-SiC is increased, the hydrogen atoms are bonded to the dangling bonds existing in the aa-SiC. Therefore, the dangling bonds decrease in the region of the intermediate layer with a higher hydrogen atomic ratio than the surface layer, and therefore, the resistance (electric resistance) of the aa-SiC increases. Thereby, when the region with a high hydrogen atomic ratio exists in the intermediate layer, the resistance in the region becomes higher than that of the other region, and therefore, a high-resistance region is formed. When a high-resistance region is formed in such an intermediate layer, transfer of the electric charges in the layer thickness direction is hindered. Therefore, the electric charges flow in the perpendicular direction to the layer thickness direction, and favorable gradation and resolution sometimes cannot be obtained. Therefore, it is conceivable that by reducing the carbon atomic ratio of the intermediate layer in at least a part of the region with a high hydrogen atomic ratio in the intermediate layer, resistance can be reduced in the region with a high hydrogen atomic ratio in the intermediate layer, and a large effect can be obtained in improvement in gradation and resolution.

Meanwhile, from the viewpoint of reduction in interference at the time of image exposure irradiation, the distribution in the layer thickness direction of the carbon atomic ratio in the intermediate layer can be continuously increase from the photoconductive layer side toward the surface layer side. Thus, the region with a high hydrogen atomic ratio for the purpose of enhancement in adhesion of the aa-SiC surface layer is formed at the surface layer side in the intermediate layer. Further, in order to obtain favorable photosensitive characteristics, the carbon atomic ratio in the region with a high hydrogen atomic ratio is reduced. In the intermediate layer outside the region with a high hydrogen atomic ratio, the conventional distribution in the layer thickness direction of the carbon atomic ratio which continuously increases the carbon atomic ratio for the purpose of reduction in interference is combined.

The distribution in the layer thickness direction of the carbon atomic ratio in the intermediate layer is set like this, the maximum region of the distribution in the layer thickness direction of the hydrogen atomic ratio in the intermediate layer is formed, and with the maximum region of the distribution in the layer thickness direction of the hydrogen atomic ratio, the minimum region is formed in the distribution in the layer thickness direction of the carbon atomic ratio in the intermediate layer. Thereby, the maximum region of the distribution in the layer thickness direction of the carbon atomic ratio is formed at the photoconductive layer side from the maximum region of the distribution in the layer thickness direction of the hydrogen atomic ratio in the intermediate layer. At this time, at least a part of the maximum region of the hydrogen atomic ratio in the intermediate layer needs to be superimposed on the minimum region of the carbon atomic ratio in the intermediate layer.

By forming such distributions in the layer thickness direction of the carbon atomic ratio and the hydrogen atomic ratio in the intermediate layer, the electrophotographic photosensitive member can be produced, in which favorable photosensitive characteristics and excellent adhesion coexist even if a sudden environmental change occurs. Further, in order to obtain the aforementioned effect, at least a part of the maximum region of the hydrogen atomic ratio in the intermediate layer needs to be superimposed on the minimum region of the carbon atomic ratio in the intermediate layer. Further, in order to obtain the aforementioned effect more, the position with the largest value of the maximum region of the hydrogen atomic ratio in the intermediate layer, and the position with the smallest value of the minimum region of the carbon atomic ratio in the intermediate layer may correspond to each other. In the distribution of the carbon atomic ratio in the aforementioned intermediate layer, the carbon atomic ratio in the maximum region of the carbon atomic ratio in the intermediate layer is characterized by being set at 0.53 to 0.63 inclusive. When the carbon atomic ratio becomes large in the aa-SiC, light absorption sometimes increases. Therefore, if the carbon atomic ratio in the maximum region of the carbon atomic ratio in the intermediate layer is made larger than 0.63, the region with large light absorption in the intermediate layer increases, and sensitivity sometimes reduces. When the carbon atomic ratio in the maximum region of the carbon atomic ratio in the intermediate layer is made smaller than 0.53, gradation sometimes reduces. The reason of this is assumed as follows. In the aa-SiC with a high carbon atomic ratio, the resistance of the aa-SiC reduces as the carbon atomic ratio reduces. From this, it is assumed that when the carbon atomic ratio in the maximum region of the carbon atomic ratio of the intermediate layer becomes smaller than 0.53, the region with low resistance increases in the intermediate layer, and therefore, the electric charges generated by image exposure are easily diffused in the directions other than the layer thickness direction, as a result of which, gradation is reduced. In the distribution of the carbon atomic ratio in the aforementioned intermediate layer, the carbon atomic ratio in the minimum region of the carbon atomic ratio in the intermediate layer is characterized by being 0.47 or more and smaller than the carbon atomic ratio in the maximum region. If the carbon atomic ratio in the minimum region of the carbon atomic ratio of the intermediate layer is made smaller than 0.47, gradation is sometimes reduced. The reason of this is assumed as follows. It is conceivable that the minimum region of the carbon atomic ratio in the intermediate layer is superimposed on the maximum region of the hydrogen atomic ratio of the intermediate layer at least partially, and therefore, reduction in resistance due to reduction in the carbon atomic ratio is less advanced as compared with the other region in the intermediate layer. It is conceivable that for this reason, the minimum region of the carbon atomic ratio of the intermediate layer can keep favorable gradation even if the minimum region of the carbon atomic ratio in the intermediate layer has a lower carbon atomic ratio than the maximum region of the carbon atomic ratio of the intermediate layer. However, it is assumed that if the carbon atomic ratio in the minimum region of the carbon atomic ratio of the intermediate layer is made smaller than 0.47, the resistance improvement effect by a high hydrogen atomic ratio cannot be sufficiently obtained, and the gradation is reduced. More favorable photosensitive characteristics can be obtained by setting the largest value of the hydrogen atomic ratio in the maximum region of the hydrogen atomic ratio in the intermediate layer at 0.50 or less in the distribution of the hydrogen atomic ratio in the aforementioned intermediate layer. When the hydrogen atomic ratio is increased in some of the regions in the intermediate layer, the hydrogen atoms which terminate dangling bonds are increased in the region, and therefore, the resistance is increased more than that of the other regions in the intermediate layer. However, if the largest value of the hydrogen atomic ratio in the maximum region of the hydrogen atomic ratio of the intermediate layer becomes larger than 0.50, resistance control by the carbon atomic ratio may be difficult in the region with a high hydrogen atomic ratio. Therefore, more favorable gradation can be obtained by setting the largest value of the hydrogen atomic ratio in the maximum region of the hydrogen atomic ratio in the intermediate layer at 0.50 or less.

In the present invention, the largest value of the carbon atomic ratio in the maximum region of the distribution of the carbon atomic ratio in the intermediate layer is set as C1, and the hydrogen atomic ratio at the position where the carbon atomic ratio in the maximum region of the distribution of the carbon atomic ratio in the intermediate layer becomes the largest value is set as H1. Further, the smallest value of the carbon atomic ratio in the minimum region of the distribution of the carbon atomic ratio in the intermediate layer is set as C2, and the largest value of the hydrogen atomic ratio in the maximum region of the distribution of the hydrogen atomic ratio in the intermediate layer is set as H2. At this time, by setting C2−C1 at −0.06 to −0.01 inclusive, and H2−H1 at 0.05 to 0.15 inclusive, that is, by satisfying the following expression 1 and expression 2, a large effect can be obtained in suppression of removal of the surface layer even if a sudden environmental change occurs, while more favorable photosensitive characteristics are maintained.

$$-0.06 \leqq C2-C1 \leqq -0.01 \quad \text{(Expression 1)}$$

$$0.05 \leqq H2-H1 \leqq 0.15 \quad \text{(Expression 2)}$$

It is conceivable that by setting C2−C1 at −0.06 to −0.01 inclusive, and H2−H1 at 0.05 to 0.15 inclusive, the resistance distribution in the layer thickness direction can be formed, which does not interfere with charge transfer in the layer thickness direction in the intermediate layer, and more favorable gradation can be obtained.

Further, the present invention does not especially limits the change of the hydrogen atomic ratio in the layer thickness direction between the maximum region of the hydrogen atomic ratio in the intermediate layer and the surface layer.

However, from the viewpoint of enhancement in adhesion, the hydrogen atomic ratio may be continuously reduced toward the intermediate layer side of the surface layer from the maximum region of the hydrogen atomic ratio in the intermediate layer.

In the present invention, a distance d2 from the maximum region of the carbon atomic ratio of the intermediate layer with respect to the layer thickness of the surface layer to the surface layer can be set at 300 angstroms to 5000 angstroms inclusive. If d2 becomes short, the region with a high hydrogen atomic ratio in the intermediate layer becomes small. Therefore, if the stress from the surface layer received by the intermediate layer becomes large, suppression of removal sometimes become difficult, and therefore, d2 can be set at 300 angstroms or more. By setting d2 at 5000 angstroms or less, light absorption in the intermediate layer can be suppressed, and more favorable sensitivity is obtained.

Further, the ratio (d2/d1) of the distance d2 from the maximum region of the carbon atomic ratio in the intermediate layer with respect to a layer thickness d1 of the surface layer to the surface layer is set at 0.05 or more, a larger effect of suppression of removal of the surface layer can be obtained. When the layer thickness d1 of the surface layer becomes large, the stress which is received by the intermediate layer from the surface layer becomes large. Further, when the distance d2 from the maximum value of the carbon atomic ratio to the surface layer becomes short, the region with a high hydrogen atomic ratio in the intermediate layer becomes small, and therefore, suppression of removal sometimes becomes difficult, if the stress from the surface layer which is received by the intermediate layer becomes large.

The distance d2 from the maximum value of the carbon atomic ratio to the surface layer will be described by using FIGS. 1A and 1B. In the case of the distributions in the layer thickness direction of the carbon atomic ratio and the hydrogen atomic ratio as shown in FIG. 1A, the distance d2 is the distance to the surface layer from the position at which the carbon atomic ratio becomes the maximum value C1 in the maximum region of the distribution of the carbon atomic ratio in the intermediate layer. Further, when the maximum region of the distribution of the carbon atomic ratio in the intermediate layer as shown in FIG. 1B is formed, the distance d2 is the distance between the surface layer and the position the closest to the surface layer side (the surface layer side of the constant layer with the carbon atomic ratio of C1) of the maximum region with the carbon atomic ratio of C1.

Further, in the present invention, the layer thickness from the photoconductive layer to the maximum region of the carbon atomic ratio in the intermediate layer may be 300 angstroms to 5000 angstroms inclusive. If a layer thickness d3 from the photoconductive layer to the maximum region of the carbon atomic ratio in the intermediate layer is made smaller than 300 angstroms, an electric discharge may become unstable at the time of layer formation. As a result, an interface may be formed between the photoconductive layer and the maximum region of the carbon atomic ratio in the intermediate layer, and removal may occur in the interface. Therefore, the layer thickness d3 from the photoconductive layer to the maximum region of the carbon atomic ratio in the intermediate region can be set at 300 angstroms or more. Further, as the region with a low carbon atomic ratio in the intermediate layer becomes larger, the region with a low resistance increases in the intermediate layer. Therefore, by making the layer thickness from the photoconductive layer to the maximum region of the carbon atomic ratio in the intermediate layer at 5000 angstroms or less, more favorable gradation is obtained.

(Surface Layer)

The present invention is characterized by setting the hydrogen atomic ratio in the surface layer at 0.30 to 0.45 inclusive. Thereby, the electrophotographic photosensitive member favorable in photosensitive characteristics and excellent in wear resistance can be obtained. In the aa-SiC surface layer with a high atom density, the sensitivity is sometimes reduced as a result that the optical band gap becomes narrow and light absorption increases. Further, when the layer thickness of the aa-SiC surface layer is made large, light absorption in the aa-SiC surface layer is increased as the layer thickness increases. Therefore, by setting the hydrogen atomic ratio at 0.30 or more, the optical band gap is widened, and light absorption can be reduced. Thus, the sensitivity can be made favorable.

Meanwhile, when the hydrogen atomic ratio is made larger than 0.45, the terminal group with a large number of hydrogen atoms such as methyl group tends to increase in the aa-SiC surface layer. When terminal groups having a plurality of hydrogen atoms such as methyl group exist in the aa-SiC surface layer, a large space is formed in the structure of aa-SiC, and a strain is generated in bonds among the atoms existing around them. Therefore, if a large number of hydrogen atoms are contained in the aa-SiC surface layer, promotion of networking of the silicon atoms and the carbon atoms which are backbone atoms in the aa-SiC surface layer becomes difficult. It is conceivable that for the reasons as above, by setting the hydrogen atomic ratio at 0.45 or less, networking of the silicon atoms and the carbon atoms which are the backbone atoms in the aa-SiC surface layer can be promoted, the strain which occurs to bonds among the atoms can be reduced, and favorable wear resistance is obtained. Therefore, by setting the hydrogen atomic ratio at 0.30 to 0.45 inclusive in the aa-SiC surface layer, favorable photosensitive characteristics can be obtained, and wear resistance can be enhanced.

Further, in the present invention, the ratio of the number of carbon atoms to the sum of the number of silicon atoms and the number of carbon atoms in the aa-SiC surface layer can be set in the range of 0.61 to 0.75 inclusive, and the sum of the atomic density of the silicon atoms and the atomic density of the carbon atoms in the aa-SiC surface layer can be set at $6.60\times10^{22}$ atom/cm$^3$ or more. By setting the sum of the atomic density of the silicon atoms and the atomic density of the carbon atoms of the aa-SiC surface layer at $6.60\times10^{22}$ atom/cm$^3$ or more, a large effect can be obtained in enhancement in wear resistance. The reason of this is shown as follows. It is conceivable that by increasing the atomic densities of the silicon atoms and the carbon atoms forming the aa-SiC surface layer, bonds of the silicon atoms and the carbon atoms are made difficult to cut, and the porosity can be reduced. It is assumed that thereby, the bonding strength of the constituent atoms of the aa-SiC surface layer becomes large, and therefore, the aa-SiC surface layer with a high hardness is obtained, as a result of which, the wear resistance is also enhanced.

Therefore, the higher the sum of the atomic density of the silicon atoms and the atomic density of the carbon atoms in the aa-SiC surface layer, the better, and by setting the sum at $6.81\times10^{22}$ atom/cm$^3$ or more, a large effect is further obtained in enhancement in wear resistance. The upper limit value of the sum of the atomic density of the silicon atoms and the atomic density of the carbon atoms in the aa-SiC of the present invention is $13.0\times10^{22}$ atom/cm$^3$. The reason of this is that in the state of crystal, the sum of the atomic density of the silicon atoms and the atomic density of the carbon atoms is the largest. Therefore, the relation of the carbon atomic ratio and atomic density in crystal is obtained by linear approximation by using the crystal of silicon carbide and the atomic density of diamond. From the obtained relational expression, the atomic density with the carbon atomic ratio of 0.75 becomes $13.0\times10^{22}$ atom/cm$^3$. Therefore, in the present invention, the upper limit of the atomic density of the silicon atoms and the atomic density of the carbon atoms is $13.0\times10^{22}$ atom/cm$^3$.

The sum of the atomic density of the silicon atoms and the atomic density of the carbon atoms is set in the above described range, and the carbon atomic ratio of the aa-SiC surface layer is set within the composition range of 0.61 to 0.75 inclusive, whereby the electrophotographic photosensitive member which is more excellent in photosensitive characteristics can be produced. When the carbon atomic ratio is made smaller than 0.61 in the aa-SiC surface layer, if the aa-SiC with a high atomic density is formed, the resistance of the aa-SiC is sometimes especially reduced. In such a case, the carriers easily cause a drift in the surface layer at the time of formation of an electrostatic latent image. Therefore, when an isolated dot is formed as an electrostatic latent image, the isolated dot becomes small due to the drift of the carriers in the surface layer. As a result, in the output image, the image density especially at the low density side is reduced, and therefore, the gradation is sometimes reduced. For such a reason, in the aa-SiC surface layer with a high atomic density, the carbon atomic ratio can be set at 0.61 or more.

Further, when the carbon atomic ratio is made larger than 0.75, if the aa-SiC with a high atomic density is formed, light absorption especially in the aa-SiC surface layer sometimes abruptly increases. In such a case, the image exposure light amount required at the time of formation of an electrostatic latent image becomes large, and the sensitivity is extremely reduced. Further, the sensitivity variation with respect to the wear amount of the aa-SiC surface layer becomes large, and therefore, when wear unevenness occurs to the electrophotographic photosensitive member, image density unevenness may occur. For such a reason, in the aa-SiC surface layer with a high atomic density, the carbon atomic ratio can be set at 0.75 or less.

In the electrophotographic photosensitive member of the present invention, a center line average roughness Ra can be in the range of 10 nm to 80 nm inclusive, and also can be in the range of 10 nm to 50 nm inclusive from the viewpoint of the easiness of cleaning of the surface of the electrophotographic photosensitive member by a cleaning blade. The center line average roughness Ra is obtained from the microscopic shape which is obtained when the surface of the electrophotographic photosensitive member is measured in the range of 10 μm×10 μm by an atomic force microscope (AFM). Further, similarly from the viewpoint of cleaning easiness, an arithmetic average inclination Δa can be in the range of 0.10 to 0.40 inclusive. The arithmetic average inclination Δa is obtained from the microscopic shape obtained when the surface of the electrophotographic photosensitive member is measured in the range of 10 μm×10 μm by an AFM.

(Photoconductive Layer)

The photoconductive layer in the electrophotographic photosensitive member of the present invention may be any photoconductive layer if only the photoconductive layer has the photoconductive characteristics which can satisfy the performance in the electrophotographic characteristics. However, the photoconductive layer formed from amorphous silicon (hereinafter, also described as "a-Si") can be used with respective to the surface layer in the present invention from the viewpoint of durability and stability, and the one formed from hydrogenated amorphous silicon may be used. When a-Si is used as the photoconductive layer in the present invention, halogen atoms can be contained in addition to hydrogen atoms, in order to compensate the dangling bonds in the a-Si. The sum of the contents of hydrogen atoms (H) and halogen atoms can be 10 atom % or more, 15 atom % or more in particular, with respect to the sum of the silicon atoms, hydrogen atoms and halogen atoms, and can be 30 atom % or less, 25 atom % or less in particular.

In the present invention, the atoms which control conductivity can be contained in the photoconductive layer according to necessity. The atoms which control conductivity may be contained in the state evenly distributed uniformly in the photoconductive layer, or there may be a portion containing the atoms in an unevenly distributed state in the layer thickness direction. As the atoms which control conductivity, a so-called impurity in the semiconductor field can be cited. More specifically, atoms (hereinafter, abbreviated as "the thirteenth group atoms") which belong to 13 group of the periodic table and gives p-type conductivity, or atoms (hereinafter, abbreviated as "the fifteenth group atoms") which belong to 15 group of the periodic table and give n-type conductivity can be used.

The thirteenth group atoms include boron (B), aluminum (Al), gallium (Ga), indium (In) and thallium (Tl) in concrete, and boron, aluminum and gallium can be used in particular. The fifteenth group atoms include phosphorous (P), arsenide (As), antimony (Sb) and bismuth (Bi), and phosphorous and arsenide can be used in particular. The content of the atoms which are contained in the photoconductive layer and control the conductivity can be $1\times10^{-2}$ atom ppm or more, especially $5\times10^{-2}$ atom ppm or more, and further $1\times10^{-1}$ atom ppm or more with respect to Si. Further, the content of such atoms can be $1\times10^{4}$ atom ppm or less, especially $5\times10^{3}$ atom ppm or less, and further $1\times10^{3}$ atom ppm or less.

In the present invention, the layer thickness of the photoconductive layer is arbitrarily determined as desired from the viewpoint of capability of obtaining desired photoelectric characteristics and economic effect. The layer thickness can be set at 15 μm or more, especially at 20 μm or more, and can be set at 60 μm or less, especially at 50 μm or less, and further at 40 μm or less. By setting the layer thickness of the photoconductive layer at 15 μm or more, increase in the passing current amount to the charged member is suppressed, and the photoconductive layer can be made hard to deteriorate. By setting the layer thickness of the photoconductive layer at 60 μm or less, the abnormally grown part of the a-Si can be made hard to grow. The photoconductive layer may be formed by a single layer, or may be formed by a plurality of layers with a charge generation layer and a charge transport layer being separated. As the method for forming the a-Si photoconductive layer, the a-Si photoconductive layer can be formed by a known method such as a plasma CVD method, a vacuum vapor-deposition method, a sputtering method, and an ion plating method, and a plasma CVD method can be adopted as a good method because of easiness in supply of a raw material.

Hereinafter, a method for forming the photoconductive layer will be described with a plasma CVD method taken as an example. In order to form the photoconductive layer, a source gas for supplying silicon atoms and a source gas for supplying hydrogen atoms are basically introduced into a reactor capable of being internally decompressed in desired gaseous states to cause a glow discharge in the reactor. Thereby, the introduced source gases are decomposed, and a layer formed from a-Si may be formed on the conductive substrate which is placed at a predetermined location in advance. In the present invention, as the source gas which can supply silicon atoms, silanes such as silane ($SiH_4$) and disilane ($Si_2H_6$) can be used. Further, as the source gas which can supply hydrogen atoms into the photoconductive layer, hydrogen ($H_2$) also can be used in addition to the above described silanes. Further, when the additives such as the aforementioned halogen atoms and atoms controlling conductivity, or carbon atoms, oxygen atoms or nitrogen atoms are contained, the substances which are gaseous or can be easily gasified including the respective atoms can be used arbitrarily as the materials.

(Charge Injection Inhibition Layer)

It is effective to provide a charge injection inhibition layer, which has the function of inhibiting injection of charges from the substrate side, between the substrate and the photoconductive layer, in the electrophotographic photosensitive member of the present invention. More specifically, the charge injection inhibition layer has the function of inhibiting injection of charges into the photoconductive layer from the substrate when the free surface of the electrophotographic photosensitive member is charged with a fixed polarity. In order to be given such a function, the charge injection inhibition layer contains a relatively large number of atoms which control conductivity as compared with the photoconductive layer. The atoms which are contained in the charge injection inhibition layer to control conductivity may be contained in the state evenly distributed uniformly in the charge injection inhibition layer, or there may be a part containing the atoms in the unevenly distributed state in the layer thickness direction. When the distribution density is uneven, the atoms can be contained so that more atoms are distributed at the substrate side. However, in any case, the atoms which control conductivity can be contained by being evenly distributed in the in-plane direction parallel to the surface of the substrate, in order to uniformize the characteristics.

As the atoms contained in the charge injection inhibition layer to control the conductivity, the thirteenth group atoms or the fifteenth group atoms can be used according to the charging polarity. Further, by containing at least one kind of atoms of carbon atoms, nitrogen atoms and oxygen atoms in the charge injection inhibition layer, adhesion between the charge injection inhibition layer and the substrate can be enhanced. At least one kind of atoms of carbon atoms, nitrogen atoms and oxygen atoms contained in the charge injection inhibition layer may be evenly distributed in the layer, or there may be a part containing the atoms in the unevenly distributed state though containing the atoms evenly in the layer thickness direction. However, in any case, the atoms can be contained by being evenly distributed in the in-plane direction parallel to the surface of the substrate, from the viewpoint of uniformizing the characteristics. The layer thickness of the charge injection inhibition layer can be set at 0.1 to 10 μm inclusive, at 0.3 to 5 μm inclusive, and further at 0.5 to 3 μm inclusive from the viewpoint of capability of obtaining desired electrophotographic characteristics and the economic effect. By setting the layer thickness at 0.1 μm or more, the injection inhibition ability for the charges from the substrate can be sufficiently included, and favorable charging ability can be obtained. Meanwhile, by setting the layer thickness at 5 μm or less, increase in manufacturing cost by extension of the formation time can be prevented.

(Substrate)

The substrate is not specially limited and may be any substrate if only the substrate has conductivity and can hold the photoconductive layer and the surface layer formed on the surface. For example, metals such as Al, Cr, Mo, Au, In, Nb, Te, V, Ti, Pt, Pd and Fe, and alloys of these metals, for example, Al alloy and stainless steel can be cited. Further, a film or sheet of a synthetic resin of polyester, polyethylene, polycarbonate, cellulose acetate, polypropylene, polyvinyl chloride, polystylene, polyamide or the like, or an electric insulating supporter of glass, ceramics or the like can be used. In this case, the surface of the electric insulating supporter at least on the side where the photoconductive layer is formed may be subjected to conducting treatment.

<Production Apparatus and Production Method for Producing Electrophotographic Photosensitive Member of the Present Invention>

Figure 3:
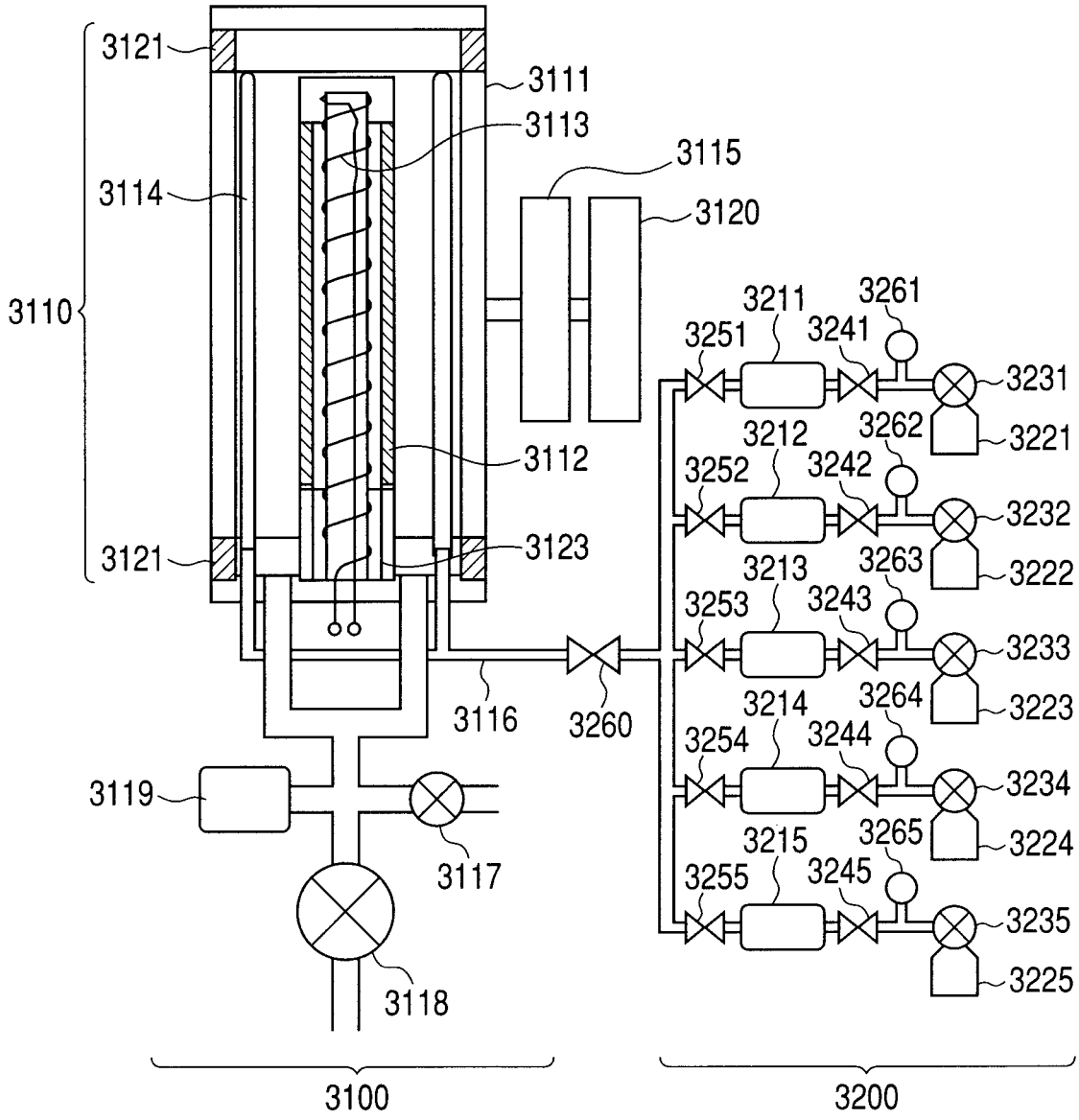
FIG. 3 is a view illustrating one example of a plasma CVD apparatus used in production of an electrophotographic photosensitive member.

FIG. 3 is a view showing one example of a plasma CVD apparatus used in production of an electrophotographic photosensitive member. The apparatus mainly includes a depositing apparatus 3100 having a reactor 3110, a source gas supply apparatus 3200, and an exhaust apparatus (not illustrated) for decompressing the inside of the reactor 3110.

In the reactor 3110, a conductive substrate 3112 connected to the earth, a conductive substrate heating heater 3113, and a source gas introduction pipe 3114 are installed. Further, a high-frequency power supply 3120 is connected to a cathode electrode 3111 insulated by an insulating material 3121, via a high-frequency matching box 3115. The source gas supply apparatus 3200 includes cylinders 3221, 3222, 3223, 3224 and 3225 of source gases such as $SiH_4$, $H_2$, $CH_4$, NO and $B_2H_6$, valves 3231, 3232, 3233, 3234 and 3235, pressure regulators 3261, 3262, 3263, 3264 and 3265, inflow valves 3241, 3242, 3243, 3244 and 3245, outflow valves 3251, 3252, 3253, 3254 and 3255 and mass flow controllers 3211, 3212, 3213, 3214 and 3215. The gas cylinders with the respective source gases sealed therein are connected to the source gas introduction pipe 3114 in the reactor 3110 via an auxiliary valve 3260 and a gas pipe 3116.

Next, the method for forming a deposition layer using the apparatus will be described. First, the conductive substrate 3112 degreased and cleaned in advance is installed in the reactor 3110 via a cradle 3123. Next, the exhausting apparatus (not illustrate) is operated, and the inside of the reactor 3110 is evacuated. While the display of a vacuum gauge 3119 is being checked, power is supplied to the substrate heating heater 3113 when the pressure in the reactor 3110 reaches a predetermined pressure of, for example, 1 Pa or less, and the conductive substrate 3112 is heated to a desired temperature of, for example, 50° C. to 350° C. inclusive. At this time, heating also can be performed in an inert gas atmosphere by supplying an inert gas such as Ar or He to the reactor 3110 from the gas supply apparatus 3200. Next, the gas for use in deposition layer formation is supplied to the reactor 3110 from the gas supply apparatus 3200. More specifically, the valves 3231, 3232, 3233, 3234 and 3235, the inflow valves 3241, 3242, 3243, 3244 and 3245 and the outflow valves 3251, 3252, 3253, 3254 and 3255 are opened according to necessity, and the flow rates are set to the mass flow controllers 3211, 3212, 3213, 3214 and 3215. When the flow rates of the respective mass flow controllers are stabilized, a main valve 3118 is operated while the display of the vacuum gauge 3119 is checked, and the pressure in the reactor 3110 is regulated so as to be a desired pressure. When the desired pressure is obtained, high-frequency power is applied by the high-frequency power supply 3120, and the high-frequency matching box 3115 is simultaneously operated to cause a plasma discharge in the reactor 3110. Thereafter, the high-frequency power is quickly regulated to a desired power, and the deposition layer is formed.

When formation of the predetermined deposition layer is finished, application of the high-frequency power is stopped, and the valves 3231, 3232, 3233, 3234 and 3235, the inflow valves 3241, 3242, 3243, 3244 and 3245, the outflow valves 3251, 3252, 3253, 3254 and 3255, and the auxiliary valve 3260 are closed to finish supply of the source gases. At the same time, the main valve 3118 is fully opened, and the inside of the reactor 3110 is evacuated to the pressure of 1 Pa or less. Formation of the deposition layer is thus finished. When a plurality of deposition layers is formed, the respective layers may be formed by repeating the above described procedures again. The source gas flow rates and the pressure are changed to the conditions for forming the photoconductive layer in a fixed time, and a joint region can be formed.

After formation of all the deposition layers is finished, the main valve 3118 is closed, a leak valve 3117 is opened and the inside of the reactor 3110 is returned to an atmospheric pressure. Thereafter, the conductive substrate 3112 is taken out from the reactor 3110. In the present invention, even when a dense aa-SiC surface layer as compared with the conventionally known surface layer is formed, favorable adhesion can be obtained while the photosensitive characteristics are maintained. As a result that a dense aa-SiC surface layer can be formed, wear resistance is enhanced, and the electrophotographic sensitive member with a longer life can be produced.

When a dense aa-SiC surface layer is formed, the lower the gas flow rate supplied to the reactor, the better, the higher the high-frequency power, the better, the higher the pressure in the reactor, the better, and the higher the temperature of the conductive substrate, the better, in general, though they depend on the conditions at the time of formation of the surface layer. First, by reducing the gas flow rate to be supplied into the reactor, and increasing the high-frequency power, decomposition of the gases can be promoted. Thereby, the carbon atom supply source (for example, $CH_4$) which is harder to decompose than the silicon atom supply source (for example, $SiH_4$) can be efficiently decomposed. As a result, the active species with the smaller number of hydrogen atoms is generated, and the hydrogen atoms in the layer deposited on the substrate are decreased. Therefore, the aa-SiC surface layer with a high atomic density can be formed.

This is considered to be because by enhancing the pressure in the reactor, the residence time of the source gas supplied into the reactor becomes long, or weakly-bonded hydrogen abstraction reaction is induced by the hydrogen atoms generated by decomposition of the source gas, and therefore, networking of the silicon atoms and carbon atoms is promoted. Furthermore, by increasing the temperature of the conductive substrate, the surface transfer distance of the active species which reaches the conductive substrate becomes long, and more stable bonds can be made. It is conceivable that as a result, the respective atoms can be bound in the arrangement which is structurally more stable for the aa-SiC surface layer.

<Electrophotographic Apparatus Having Electrophotographic Photosensitive Member of the Present Invention>

An image forming method by an electrophotographic apparatus having the a-Si photosensitive member will be described by using FIG. 6. First, an electrophotographic photosensitive member 6001 is rotated, and the surface of the electrophotographic photosensitive member 6001 is uniformly charged by a main charger 6002. Thereafter, by an electrostatic latent image unit 6006, the surface of the electrophotographic photosensitive member 6001 is irradiated with light, and an electrostatic latent image is formed on the surface of the electrophotographic photosensitive member 6001. Thereafter, development is performed by using a toner supplied from a developing machine 6012. As a result, a toner image is formed on the surface of the electrophotographic photosensitive member 6001. Subsequently, a transfer material 6010 is conveyed by a conveying unit 6011, the toner image is transferred onto the transfer material 6010 by a transfer charger 6004, the transfer material 6010 is separated by a separating charger 6005, from the electrophotographic photosensitive member 6001, and the toner image is fixed onto the transfer material 6010.

Meanwhile, the toner remaining on the surface of the electrophotographic photosensitive member 6001 after the toner image is transferred is removed by a cleaner 6009 having a magnet roller 6007 and a cleaning blade 6008. Thereafter, the surface of the electrophotographic photosensitive member 6001 is exposed by a neutralizer 6003, and thereby, the residual carriers at the time of electrostatic latent image in the electrophotographic photosensitive member 6001 are neutralized. By repeating the series of processes, image formation is continuously performed. The electrophotographic apparatus loaded with the electrophotographic photosensitive member of the present invention is not especially limited, and with the conventional electrophotographic apparatus illustrated in FIG. 6, the effect larger than that of the conventional electrophotographic photosensitive member can be obtained in wear resistance.

Hereinafter, the present invention will be described in more detail by examples and comparative examples, but the present invention is not limited by these examples.

Experimental Example 1

By using the plasma processing apparatus shown in FIG. 3 using a high-frequency power supply in a RF band as a frequency, a charge injection inhibition layer and a photoconductive layer were formed under the conditions shown in the following Table 1 on the cylindrical substrate (cylindrical aluminum substrate with mirror machining applied of a diameter of 80 mm, a length of 358 mm and a thickness of 3 mm). After the photoconductive layer was formed, a positively chargeable a-Si photosensitive member was produced under the conditions shown in the following Table 4 by using the intermediate layer forming conditions shown in the following Table 2 and the surface layer forming conditions shown in the following Table 3. At this time, with respect to Nos. 1 and 2 of the layer forming conditions of the following Table 4, in a variable layer 1, the layer formation time was regulated so that the layer thickness was 0.20 μm, and the internal pressure and the high-frequency power were set at the same conditions as a constant layer 1. Further, the $CH_4$ flow rate was 0 sccm (standard $cm^3$/min) at the time of start of the layer formation of the variable layer 1, and was linearly changed to be the $CH_4$ flow rate of the constant layer 1 at the time of finishing the variable layer 1.

With respect to the layer forming condition Nos. 3 to 7 of the following Table 4, the variable layer 1 was formed similarly to the layer forming condition Nos. 1 and 2. With respect to a variable layer 2 and a variable layer 3, the layer formation time was regulated to obtain the layer thickness shown in Table 1. Further, the variable layer 2 and the variable layer 3 were formed by linearly changing the high-frequency power, the $SiH_4$ flow rate, the $CH_4$ flow rate and the internal pressure from the layer forming conditions of the layers formed before the respective variable layer to the layer forming conditions of the layers to be formed after the respective variable layers. The arrows in the Table shows the linear change to the layer forming conditions in the layer to be formed after formation of the variable layer from the layer formed before formation of the variable layer. With respect to the layer forming condition No. 8 of the following Table 4, the layer was formed by switching the high-frequency power, the $SiH_4$ flow rate, the $CH_4$ flow rate and the internal pressure so that the layer thickness between the photoconductive layer and the surface layer practically became 0 μm.

TABLE 1

| | Charge injection inhibition layer | Photoconductive layer | Intermediate layer: Variable layer 1 | Constant layer 1 | Variable layer 2 | Constant layer 2 | Variable layer 3 | Surface layer |
|---|---|---|---|---|---|---|---|---|
| Gas species and flow rate | | | | | | | | |
| $SiH_4$ [mL/min (normal)] | 350 | 450 | 26 | 26 | → | 26 | → | 26 |
| $H_2$ [mL/min (normal)] | 750 | 2200 | | | | | | |
| $B_2H_6$ [ppm] (vs. $SiH_4$) | 1500 | 1 | | | | | | |
| NO [mL/min (normal)] | 10 | | | | | | | |
| $CH_4$ [mL/min (normal)] | | | 0→※ | ※ | → | ※ | → | 320 |
| Internal pressure [Pa] | 40 | 80 | ※ | ※ | → | ※ | → | 80 |
| High-frequency power [W] | 400 | 800 | ※ | ※ | → | ※ | → | 700 |
| Substrate temperature [° C.] | 260 | 260 | 290 | 290 | 290 | 290 | 290 | 290 |
| Layer thickness [μm] | 3 | 25 | 0.20 | ※ | 0.10 | ※ | 0.15 | ※ |

TABLE 2

| Intermediate layer forming condition No. | Intermediate 1 | Intermediate 2 | Intermediate 3 | Intermediate 4 | Intermediate 5 | Intermediate 6 |
|---|---|---|---|---|---|---|
| $CH_4$ [mL/min (normal)] | 600 | 260 | 320 | 400 | 320 | 450 |
| Internal pressure (Pa) | 33 | 33 | 67 | 53 | 67 | 53 |
| High-frequency power (W) | 300 | 250 | 300 | 450 | 500 | 250 |
| Layer thickness (μm) | 0.03 | 0.03 | 0.02 | 0.02 | 0.02 | 0.02 |

TABLE 3

| Surface layer forming condition No. | Surface 1 | Surface 2 |
|---|---|---|
| Layer thickness (μm) | 0.10 | 0.50 |

TABLE 4

| Layer forming condition No. | Charge injection inhibition layer | Photoconductive layer | Intermediate layer: Variable layer 1 | Constant layer 1 | Variable layer 2 | Constant layer 2 | Variable layer 3 | Surface layer |
|---|---|---|---|---|---|---|---|---|
| 1 | Table 1 | Table 1 | Present | Intermediate 1 | Absent | Absent | Absent | Absent |
| 2 | Table 1 | Table 1 | Present | Intermediate 2 | Absent | Absent | Absent | Absent |
| 3 | Table 1 | Table 1 | Present | Intermediate 1 | Present | Intermediate 3 | Present | Surface 1 |
| 4 | Table 1 | Table 1 | Present | Intermediate 1 | Present | Intermediate 4 | Present | Surface 1 |
| 5 | Table 1 | Table 1 | Present | Intermediate 1 | Present | Intermediate 5 | Present | Surface 1 |
| 6 | Table 1 | Table 1 | Present | Intermediate 1 | Present | Intermediate 6 | Present | Surface 1 |
| 7 | Table 1 | Table 1 | Present | Intermediate 2 | Present | Intermediate 3 | Present | Surface 1 |
| 8 | Table 1 | Table 1 | Absent | Absent | Absent | Absent | Absent | Surface 2 |

By using the electrophotographic photosensitive members of the layer forming condition Nos. 1 to 7 produced according to experimental example 1, the carbon atomic ratios, the hydrogen atomic ratios, C2–C1 and H2–H1 in the intermediate layers were obtained by the analytical method which will be described later. Further, by using the electrophotographic photosensitive member of the layer forming condition No. 8, the carbon atomic ratio, the hydrogen atomic ratio, the atomic density of silicon atoms (hereinafter, also described as "Si atomic density"), the atomic density of carbon atoms (hereinafter, also described as "C atomic density"), and the sum of the aforesaid Si atomic density and the aforesaid C atomic density (hereinafter, also described as "Si+C atomic density") in the surface layers were obtained by the analytical method which will be described later. These results are shown in Table 5.

(Measurement of Carbon Atomic Ratio, Hydrogen Atomic Ratio, C2–C1 and H2–H1)

The central portion in the longitudinal direction in an arbitrary circumferential direction of each of the electrophotographic photosensitive members produced under the respective layer forming conditions of experimental example 1 was cut out by 15 mm square (15 mm×15 mm) to prepare the measuring specimens. Subsequently, by RBS (Rutherford Backscattering Spectroscopy) (Backscattering measuring apparatus AN-2500 made by NHV Corporation), the depth direction measurement of the number of silicon atoms and carbon atoms in the measured area of RBS was performed for each of the measurement specimens. From the measured numbers of silicon atoms and carbon atoms, the distribution of the carbon atomic ratio in the layer thickness direction in the intermediate layer, and the carbon atomic ratios in the intermediate layer and the surface layer were obtained. When the maximum region and the minimum region were formed in the distribution of the carbon atomic ratio in the layer thickness direction in the intermediate layer, the largest value C1 of the carbon atomic ratio in the maximum region and the smallest value C2 of the carbon atomic ratio in the minimum region were obtained, and C2−C1 that is the difference was obtained.

Simultaneously with the RBS, by HFS (Hydrogen Forward Spectroscopy) (Backscattering measuring device AN-2500 made by NHV Corporation), the number of hydrogen atoms in the surface layer in the measured area of HFS was measured for each of the aforementioned measurement specimens. Measurement in the depth direction of the number of hydrogen atoms obtained from the measured area of HFS was performed. By using the number of silicon atoms and the number of carbon atoms obtained from the measured area of RBS, the hydrogen atomic ratio distribution in the layer thickness direction in the intermediate layer, and the hydrogen atomic ratios of the intermediate layer and the surface layer were obtained. Further, when the maximum region was formed in the distribution of the carbon atomic ratio in the layer thickness direction in the intermediate layer, the hydrogen atomic ratio H1 at the position of the largest value C1 in the maximum region of the distribution of the carbon atomic ratio was obtained.

Further, when the maximum region was formed in the distribution of the hydrogen atomic ratio in the layer thickness direction in the intermediate layer, the largest value H2 of the hydrogen atomic ratio in the maximum region of the distribution of the hydrogen atomic ratio was obtained, and H2−H1 that is the difference was obtained. The concrete measurement conditions of RGS and HFS were an incident ion of 4He+, an incident energy of 2.3 MeV, an incident angle of 75°, a specimen current of 35 nA and an incident beam diameter of 1 mm. Measurement was performed with the detector of RBS with a scattering angle of 160° and an aperture diameter of 8 mm, and the detector of HFS with a recoil angle of 30° and an aperture diameter of 8 mm+Slit.

(Layer Thickness Measurement)

The measurement specimens used in the measurement of the carbon atomic ratio and the measurement of the hydrogen atomic ratio were each cut out into a piece 3 mm square (3 mm×3 mm) and 1 mm deep. The cutout measurement specimens were subjected to thin slice processing to be thin pieces each of a width of 0.05 μm to 0.15 μm inclusive and a depth (layer thickness direction) of 3 μm to 5 μm inclusive by using FIB (FB-2100 made by Hitachi High-Technologies Corporation). Next, the measurement specimens subjected to thin slice processing were observed in the layer thickness direction by Transmission Electron Microscope: TEM (H-7500 type made by Hitachi High-Technologies Corporation), and from the obtained transmission images, the layer thickness of the intermediate layer and/or the surface layer formed under each of the layer forming conditions was confirmed.

(Measurement of Si+C Atomic Density, Si Atomic Density and C Atomic Density)

By using the numbers of silicon atoms and carbon atoms obtained from the measured areas of RBS obtained from the aforementioned measurement of the carbon atomic ratios and the measurement of the hydrogen atomic ratios, and the layer thicknesses of the surface layers obtained by the aforementioned layer thickness measurement, the Si atomic densities, the C atomic densities and the Si+C atomic densities were obtained. As for experimental example 1, the following is shown in Table 5 with respect to the layer forming condition Nos. 3 to 7.

Figure 4A:
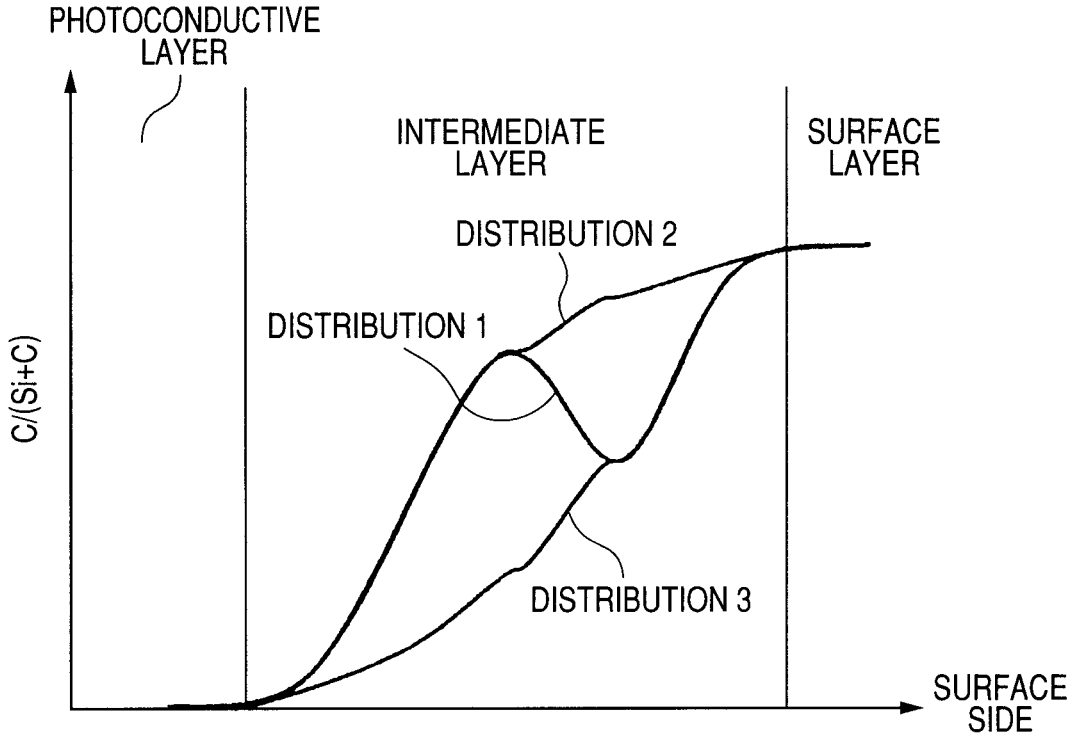
FIG. 4A is a diagram illustrating a distribution in a layer thickness direction of a carbon atomic ratio.
Figure 4B:
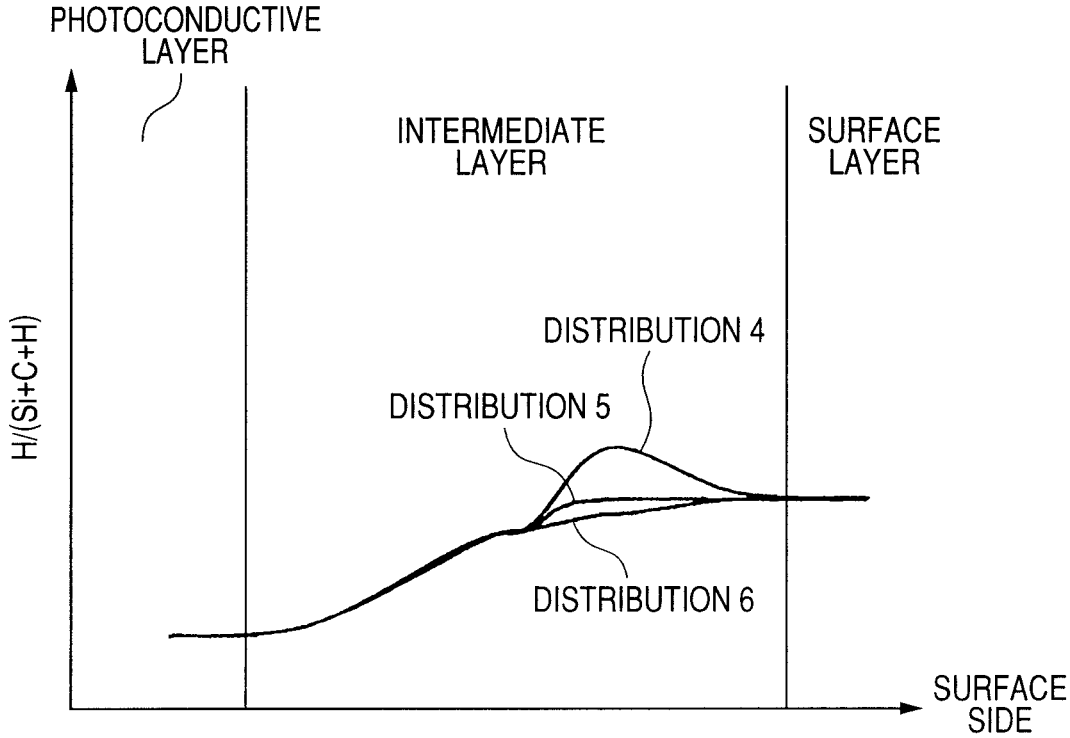
FIG. 4B is a diagram illustrating a distribution in a layer thickness direction of a hydrogen atomic ratio.
Figure 5A:
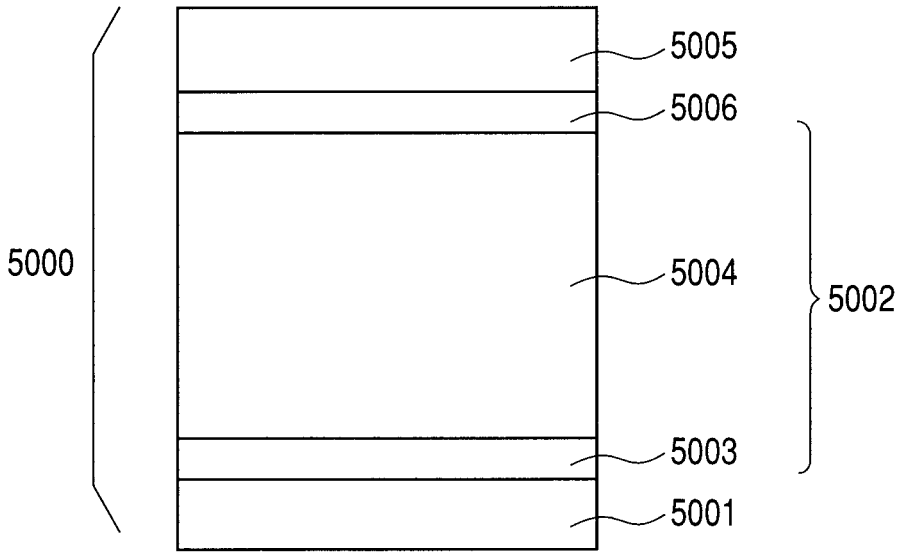
FIG. 5A is a view illustrating one example of a layer constitution of a positively chargeable a-Si photosensitive member.
Figure 5B:
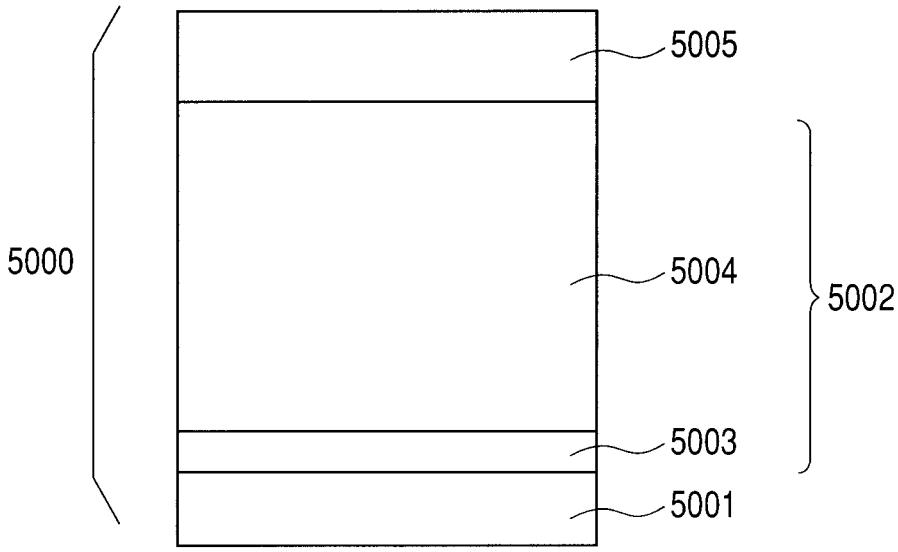
FIG. 5B is a view illustrating one example of a layer constitution of a positively chargeable a-Si photosensitive member.

1) Distributions in the layer thickness direction of the carbon atomic ratio and the hydrogen atomic ratio in the intermediate layer 2) Largest value C1 of the carbon atomic ratio in the maximum region of the carbon atomic ratio 3) Smallest value H1 of the hydrogen atomic ratio at the position of the largest value C1 of the carbon atomic ratio in the maximum region of the carbon atomic ratio 4) Smallest value C2 of the carbon atomic ratio in the minimum region of the carbon atomic ratio 5) Largest value H2 of the hydrogen atomic ratio in the maximum region of the hydrogen atomic ratio Further, with respect to the layer forming condition No. 8, Table 5 shows the carbon atomic ratio, the hydrogen atomic ratio, the Si atomic density, the C atomic density and the Si+C atomic density of the surface layer. The distributions in the layer thickness direction of the carbon atomic ratio and the hydrogen atomic ratio are written in the Table by using the distributions illustrated in FIGS. 4A and 4B.

TABLE 5

| | Intermediate layer | | | | | | | | Surface layer | | | | |
|---|---|---|---|---|---|---|---|---|---|---|---|---|---|
| | Carbon atomic ratio | | | Hydrogen atomic ratio | | | | | | Si | C | Si + C | |
| Layer forming condition No. | C1 | C2 | Layer thickness direction distribution | H1 | H2 | Layer thickness direction distribution | C2 − C1 | H2 − H1 | Carbon atomic ratio | atomic density ($10^{22}$ atom/cm$^3$) | atomic density ($10^{22}$ atom/cm$^3$) | atomic density ($10^{22}$ atom/cm$^3$) | Hydrogen atomic ratio |
| 3 | 0.62 | 0.60 | Distribution 1 | 0.33 | 0.45 | Distribution 4 | −0.02 | 0.12 | 0.71 | — | — | — | 0.39 |
| 4 | — | — | Distribution 2 | — | — | Distribution 5 | — | — | 0.71 | — | — | — | 0.39 |
| 5 | — | — | Distribution 2 | — | 0.42 | Distribution 4 | — | — | 0.71 | — | — | — | 0.39 |
| 6 | 0.62 | 0.57 | Distribution 1 | 0.33 | — | Distribution 6 | −0.05 | — | 0.71 | — | — | — | 0.39 |
| 7 | — | — | Distribution 3 | — | 0.45 | Distribution 4 | — | — | 0.71 | — | — | — | 0.39 |
| 8 | — | — | — | — | — | — | — | — | 0.71 | 2.07 | 5.07 | 7.14 | 0.39 |

With respect to the electrophotographic photosensitive member of the layer forming condition No. 1 in which only the variable layer 1 and the constant layer 1 were formed on the photoconductive layer, the carbon atomic ratio was 0.62 and the hydrogen atomic ratio was 0.33 in the constant layer 1. Further, with respect to the electrophotographic photosensitive member of the layer forming condition No. 2 in which only the variable layer 1 and the constant layer 1 were formed on the photoconductive layer, the carbon atomic ratio was 0.54 and the hydrogen atomic ratio was 0.32 in the constant layer 1, as in the layer forming condition No. 1. Regarding the layer forming condition No. 3, ununiform distributions in the layer thickness direction of the carbon atomic ratio and the hydrogen atomic ratio as shown in FIG. 1A were obtained. Further, the smallest value in the minimum region of the carbon atomic ratio and the largest value in the maximum region of the hydrogen atomic ratio were at the same position in the layer thickness direction.

Further, the largest value of the maximum region in the layer thickness direction of the carbon atomic ratio in the intermediate layer was in the region of the constant layer 1, and the smallest value of the minimum region in the layer thickness direction of the carbon atomic ratio in the intermediate layer and the largest value of the maximum region in the layer thickness direction of the hydrogen atomic ratio in the intermediate layer were in the region of the constant layer 2. The region from the variable layer 1 to the constant layer 1 had the distributions in the layer thickness direction of the carbon atomic ratio and the hydrogen atomic ratio similar to those in the layer forming condition No. 1. Regarding the layer forming condition No. 4, the distribution in the layer thickness direction of the carbon atomic ratio in the layer thickness direction of the carbon atomic ratio and the hydrogen atomic ratio as illustrated in FIG. 2B was the distribution which continuously increased toward the surface layer. Further, the region from the variable layer 1 to the constant layer 1 had the distributions in the layer thickness direction of the carbon atomic ratio and the hydrogen atomic ratio similarly to those in the layer forming condition Nos. 1 and 3.

Figure 2A:
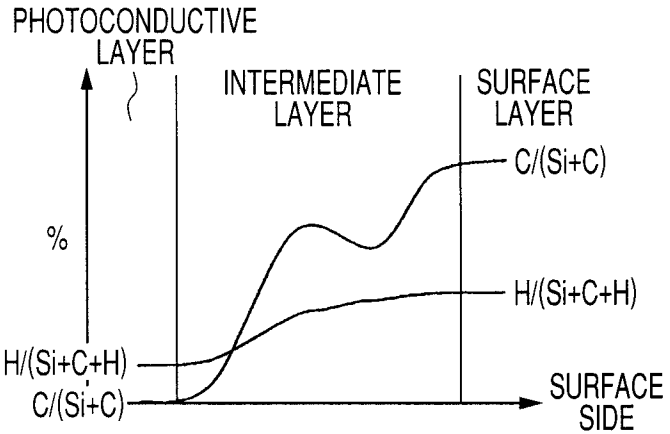
FIG. 2A is a diagram illustrating distributions in a layer thickness direction of a carbon atomic ratio and a hydrogen atomic ratio of an intermediate layer of a comparative example.
Figure 2B:
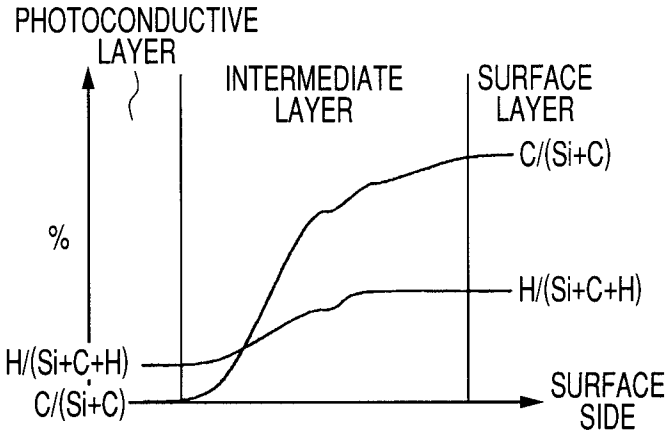
FIG. 2B is a diagram illustrating the distributions in the layer thickness direction of the carbon atomic ratio and the hydrogen atomic ratio of the intermediate layer of the comparative example.

Regarding the layer forming condition No. 6, the distribution in the layer thickness direction of the carbon atomic ratio as shown in FIG. 2A was the ununiform distribution in the layer thickness direction, the distribution having the maximum region and the minimum region in the carbon atomic ratio. Further, the distribution in the layer thickness direction of the hydrogen atomic ratio was the distribution which continuously increased toward the surface layer. The hydrogen atomic ratio at the position of the smallest value of the minimum region in the layer thickness direction of the carbon atomic ratio had the value equivalent to that of the surface layer, and the maximum region did not exist in the layer thickness direction of the hydrogen atomic ratio. Further, the region from the variable layer 1 to the constant layer 1 had the distributions in the layer thickness direction of the carbon atomic ratio and the hydrogen atomic ratio similarly to those of the layer forming condition Nos. 1, 3 and 4. Regarding the layer forming condition Nos. 5 and 7, the distribution in the layer thickness direction of the carbon atomic ratio was the distribution which continuously increased toward the surface layer. Further, the distribution in the layer thickness direction of the hydrogen atomic ratio was the ununiform distribution in the layer thickness direction, the distribution having the maximum region in the hydrogen atomic ratio. Under the layer forming condition No. 5, the distributions in the layer thickness direction of the carbon atomic ratio and the hydrogen atomic ratio illustrated in FIG. 2C were obtained, and under the layer forming condition No. 7, the distributions in the layer thickness direction of the carbon atomic ratio and the hydrogen atomic ratio illustrated in FIG. 2D were obtained.

The region from the variable layer 1 to the constant layer 1 under the layer forming condition No. 5 had the distributions in the layer thickness direction of the carbon atomic ratio and the hydrogen atomic ratio similarly to those in the layer forming condition Nos. 1, 3, and 6. The region from the constant layer 2 to the surface layer of the layer forming condition No. 7 had the distributions in the layer thickness direction of the carbon atomic ratio and the hydrogen atomic ratio similar to those in the layer forming condition No. 3. Further, the region from the variable layer 1 to the constant layer 1 had the distributions in the layer thickness direction of the carbon atomic ratio and the hydrogen atomic ratio similar to those in the layer forming condition No. 2, and had the distribution with a lower carbon atomic ratio than that of the region from the variable layer 1 to the constant layer 1 in the layer forming conditions 3, 4, 5 and 6. Therefore, the distributions in the layer thickness direction of the carbon atomic ratio in the intermediate layers in the layer forming condition Nos. 5 and 7 are such that the carbon atomic ratios at the closest side to the photoconductive layer and the closest side to the surface layer in the intermediate layer were equivalent, and in the other region in the intermediate layer, the layer forming condition No. 7 had the distribution in the layer thickness direction with a lower carbon atomic ratio than the layer forming condition No. 5.

Example 1

By using the plasma processing apparatus using a high-frequency power supply in an RF band as a frequency illustrated in FIG. 3 as in experimental example 1, the charge injection inhibition layer and the photoconductive layer were formed on the cylindrical substrate under the conditions shown in the above described Table 1. After the photoconductive layer was formed, the surface layer was formed under the conditions of the layer forming condition No. 3 shown in the above described Table 4, and five positively chargeable a-Si photosensitive members were produced. At this time, the layer thickness of the surface layer was regulated to be 2.00 μm. The intermediate layer forming conditions in the layer forming condition No. 3 shown in the above described Table 4 are shown in the above described Table 2. With respect to the five electrophotographic photosensitive members produced according to example 1, the surface roughness was measured under the conditions which will be described later, and Ra and Δa were calculated. Thereafter, by using the four electrophotographic photosensitive members, adhesion was evaluated under the evaluation conditions which will be described later. By the remaining one electrophotographic photosensitive member, gradation and sensitivity were evaluated under the evaluation conditions which will be described later. The results are shown in Table 6.

Comparative Example 1

By using a plasma processing apparatus using a high-frequency power supply in an RF band as a frequency illustrated in FIG. 3 as in example 1, five positively chargeable a-Si photosensitive members were produced. However, as the intermediate layer forming conditions, the conditions of the layer forming condition No. 4 to 7 shown in the above described Table 4 were adopted. At this time, the layer thickness of the surface layers was regulated to be 2.00 μm. With respect to the electrophotographic photosensitive members produced according to comparative example 1, the surface roughness was calculated, and thereafter, the adhesion, gradation and sensitivity were evaluated as in example 1. The results are shown in Table 6.

(Adhesion Evaluation)

The method for evaluating adhesion was carried out by using an accelerated evaluation method as follows. First, the evaluation positions are nine positions in total that are three points (0 mm, ±130 mm with the center in the longitudinal direction of the electrophotographic photosensitive member as the reference) in the longitudinal direction in an arbitrary circumferential direction of the produced electrophotographic photosensitive member, and three points in the longitudinal direction at each of the positions rotated by 120° and 240° from the aforesaid arbitrary circumferential direction. The surface of the electrophotographic photosensitive member was marked by cutter knife in the range of 50 mm×50 mm around the aforementioned measurement positions, and 25 squares of 10 mm×10 mm were made. The marks on the surface of the electrophotographic photosensitive member which were produced at this time were made so as to reach the substrate. By the aforementioned method, marks were made in the four electrophotographic photosensitive members which were produced. The four electrophotographic photosensitive members were put in a case, pure water was poured until all of the electrophotographic photosensitive members were covered with the pure water, and they were left for two weeks.

After left in the pure water for two weeks, the electrophotographic photosensitive members were taken out of the case, and separation was checked in the squares of 10 mm×10 mm. The ratio of the range of 50 mm×50 mm where separation occurs for the total of 36 points of the ranges of 50 mm×50 mm was obtained, and adhesion was evaluated. At this time, when separation occurs in only one range of the square of 10 mm×10 mm, the range of 50 mm×50 mm of this was counted as the range where separation occurred, irrespective of the number of separations which occurred in the squares of 10 mm×10 mm in the range of 50 mm×50 mm. Subsequently, evaluation was performed by using relative comparison as an indicator of adhesion. In the relative comparison, the ratio of the ranges where separation occurred to the 36 points in total of the ranges of 50 mm×50 mm in the electrophotographic photosensitive member produced in the layer forming condition No. 4 which was produced in comparative example 1 was set as 1.00. For the adhesion evaluation, if C or higher mark is given, the effect of the present invention is determined to be obtained.

A. The ratio of the number of ranges of 50 mm×50 mm where separations occur to the 36 points in total in the ranges of 50 mm×50 mm in the respective layer forming conditions, relative to the ratio of the number of ranges of 50 mm×50 mm where separations occur to the 36 points in total in the ranges of 50 mm×50 mm in the layer forming condition No. 4 of comparative example 1 is less than 0.10.

B. The ratio of the number of ranges of 50 mm×50 mm where separations occur to the 36 points in total in the ranges of 50 mm×50 mm in the respective layer forming conditions, relative to the ratio of the number of ranges of 50 mm×50 mm where separations occur to the 36 points in total in the ranges of 50 mm×50 mm in the layer forming condition No. 4 of comparative example 1 is 0.10 or more and less than 0.25.

C. The ratio of the number of ranges of 50 mm×50 mm where separations occur to the 36 points in total in the ranges of 50 mm×50 mm in the respective layer forming conditions, relative to the ratio of the number of ranges of 50 mm×50 mm where separations occur to the 36 points in total in the ranges of 50 mm×50 mm in the layer forming condition No. 4 of comparative example 1 is 0.25 or more and less than to 0.50.

D. The ratio of the number of ranges of 50 mm×50 mm where separations occur to the 36 points in total in the ranges of 50 mm×50 mm in the respective layer forming conditions, relative to the ratio of the number of ranges of 50 mm×50 mm where separations occur to the 36 points in total in the ranges of 50 mm×50 mm in the layer forming condition No. 4 of comparative example 1 is 0.50 or more.

(Gradation Evaluation)

For gradation evaluation, the modified machine of the digital electrophotographic apparatus iR-5065 made by Canon Inc. was used. At first, by the area coverage modulation (that is area coverage modulation of the dot portions for performing image exposure) by using an area coverage modulation dot screen with a linear density of 170 lpi (170 lines per inch) at 45 degrees by image exposure light, the gradation data with the entire gradation range evenly divided into 18 steps was created. At this time, respective steps of gradation are assigned with numbers, with the darkest step of gradation assigned with 17 and the lightest step of gradation assigned with zero to provide the steps of gradation. Next, the electrophotographic photosensitive member is placed in the above described modified electrophotographic apparatus, and output is performed on an A3 sheet by using a text mode, by using the above described gradation data. At this time, output is performed in the condition of keeping the surface of the electrophotographic photosensitive member at 40° C. by turning on the photosensitive member heater under the environment at a temperature of 22° C. and relative humidity of 50%. The image density of the obtained image was measured for each gradation by a spectrodensitometer (504 spectral densitometer made by X-Rite Inc.). In the spectrodensitometer measurement, three images were output for each gradation, and the average value of the densities was made the evaluation value. The correlation coefficients of the evaluation values thus obtained and the gradation steps were calculated. Evaluation was made by using, as the indicator, the relative comparison with the correlation coefficient of the electrophotographic photosensitive member produced in the layer forming condition No. 7 produced in comparative example 1 set as 1.00. In the evaluation, a larger numeric value indicates that more excellent gradation is obtained and gradation expression closer to a straight line is made. When C is given for the gradation evaluation, it is determined that the effect of the present invention was obtained.

A. The ratio of the correlation coefficient of the electrophotographic photosensitive member produced under each of the layer forming conditions to the correlation coefficient of the electrophotographic photosensitive member in the layer forming condition No. 7 produced in comparative example 1 is 1.10 or more.

B. The ratio of the correlation coefficient of the electrophotographic photosensitive member produced under each of the layer forming conditions to the correlation coefficient of the electrophotographic photosensitive member in the layer forming condition No. 7 produced in comparative example 1 is 1.07 or more and less than 1.10.

C. The ratio of the correlation coefficient of the electrophotographic photosensitive member produced under each of the layer forming conditions to the correlation coefficient of the electrophotographic photosensitive member in the layer forming condition No. 7 produced in comparative example 1 is 1.04 or more and less than 1.07.

D. The ratio of the correlation coefficient of the electrophotographic photosensitive member produced under each of the layer forming conditions to the correlation coefficient of the electrophotographic photosensitive member in the layer forming condition No. 7 produced in comparative example 1 is less than 1.04.

(Sensitivity Evaluation)

A modified machine of the digital electrophotographic apparatus iR-5065 made by Canon Inc. was used. A high voltage power supply was connected to the wire and grid of the charger with the image exposure cut off, and the grid potential was set at 820 V. The current supplied to the wire of the charger was regulated and set so that the surface potential of the electrophotographic photosensitive member was at 400 V. Next, in the charged state under the charging conditions set in advance, image exposure light was irradiated, and the irradiation energy was regulated, whereby the potential at the developing unit position was at 100 V. The image exposure light source of the electrophotographic apparatus used in the sensitivity evaluation is a semiconductor laser with an oscillation wavelength of 658 nm. The evaluation result was shown by the relative comparison with the irradiation energy in the case of being loaded with the electrophotographic photosensitive member in the layer forming condition No. 4 produced in comparative example 1 set at 1.00. For the sensitivity evaluation, when B or more was given, it is determined that the effect of the present invention is obtained.

A. The ratio of the irradiation energy to the irradiation energy in the electrophotographic photosensitive member in the layer forming condition No. 4 produced in comparative example 1 is less than 1.10.

B. The ratio of the irradiation energy to the irradiation energy in the electrophotographic photosensitive member in the layer forming condition No. 4 produced in comparative example 1 is 1.10 or more and less than 1.15.

C. The ratio of the irradiation energy to the irradiation energy in the electrophotographic photosensitive member in the layer forming condition No. 4 produced in comparative example 1 is 1.15 or more.

(Measurement of Surface Roughness)

In two electrophotographic photosensitive members, the central portions in the longitudinal direction in an arbitrary circumferential direction were measured by an atomic force microscope (AFM) (Q-SCOPE 250 (Version 3.181) made by Quesant Instrument Corporation), and the center line average roughness Ra and the arithmetic average inclination Δa were calculated. The obtained average values of Ra and Δa were set as the values of Ra and Δa. In concrete, by using a head: Tape 10 and a probe: NSC 16, the range of 10 μm×10 μm was measured by Wavemade under the measurement conditions of a scan rate of 4 Hz, an integral gain of 600, a proportional gain of 500, and a scan resolution of 300. The AFM observation image obtained by the analysis software: Q-SCOPE 250 made by Quesant Instrument Corporation was corrected by using Parabolic Line By Line of Tilt Removal. Ra and Δa were calculated by analyzing the corrected AFM observation image in Histogram Analysis. For Ra in the Histogram Analysis, the value expressed by Meas Deviation was used. With respect to example 1 and comparative example 1, the results relating to the adhesion, gradation and sensitivity in the intermediate layers are shown in Table 6. C1, C2, H1 and H2 written in Table 6 are the results calculated based on experimental example 1.

From experimental example 1, the electrophotographic photosensitive member produced in the layer forming condition No. 3 had the distribution in which the largest value of the hydrogen atomic ratio in the maximum region of the distribution of the hydrogen atomic ratio in the intermediate layer was larger than the hydrogen atomic ratio in the surface layer, the maximum region and the minimum region were included in the distribution of the carbon atomic ratio in the layer thickness direction, and at least a part of the minimum region of the hydrogen atomic ratio in the intermediate layer is superimposed on the maximum region of the carbon atomic ratio in the intermediate layer. It has been found out that by having such a distributions in the layer thickness direction of the carbon atomic ratio and the hydrogen atomic ratio in the intermediate layer, the electrophotographic photosensitive member has favorable adhesion while maintaining favorable photosensitive characteristics. The surface layers used in example 1 and comparative example 1 were formed in the same layer forming conditions as in experimental example 1. The Si+C atomic densities of the surface layers are each $7.14\times10^{22}$ atom/cm$^3$, and it has been found out that by using the intermediate layer formed in example 1, favorable adhesion can be obtained even if the high-density surface layer is formed. Further, the surface layers each had a carbon atomic ratio of 0.71 and a hydrogen atomic ratio of 0.39. As for the surface roughness of each of the electrophotographic photosensitive member produced in example 1 and comparative example 1, Ra was in the range of 32 nm to 36 nm inclusive, and Δa was in the range of 0.13 to 0.16 inclusive.

Example 2

Similarly to example 1, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 7. At this time, the intermediate layers were formed under the conditions described in the layer forming condition No. shown in the following Table 9 by using the intermediate layer forming conditions shown in the following Table 8, and seven positively chargeable a-Si photosensitive members were produced under the respective layer forming conditions. Further, the layer thickness of the surface layer was formed by being adjusted to be 2.00 μm for five of the produced electrophotographic photosensitive members, 0.30 μm for one of the produced electrophotographic photosensitive members, and 0.05 μm for the remaining one.

TABLE 6

| | Layer forming condition | Intermediate layer | | | | | | | | |
|---|---|---|---|---|---|---|---|---|---|---|
| | | Carbon atomic ratio | | Hydrogen atomic ratio | | | | | | |
| | No. | C1 | C2 | H1 | H2 | C2 − C1 | H2 − H1 | Adhesion | Gradation | Sensitivity |
| Ex. 1 | 3 | 0.62 | 0.60 | 0.33 | 0.45 | −0.02 | 0.12 | A | A | A |
| Com. Ex. | 4 | — | — | — | — | — | — | D | B | A |
| 1 | 5 | — | — | — | 0.42 | — | — | A | D | A |
| | 6 | 0.62 | 0.57 | 0.33 | — | −0.05 | — | D | B | A |
| | 7 | — | — | — | 0.45 | — | — | A | D | A |

TABLE 7

| | Charge injection inhibition layer | Photoconductive layer | Intermediate layer: Variable layer 1 | Constant layer 1 | Variable layer 2 | Constant layer 2 | Variable layer 3 | Surface layer |
|---|---|---|---|---|---|---|---|---|
| Gas species and flow rate | | | | | | | | |
| $SiH_4$ [mL/min (normal)] | 350 | 450 | 26 | 26 | → | 26 | → | 26 |
| $H_2$ [mL/min (normal)] | 750 | 2200 | | | | | | |
| $B_2H_6$ [ppm] (vs. $SiH_4$) | 1500 | 1 | | | | | | |
| NO [mL/min (normal)] | 10 | | | | | | | |
| $CH_4$ [mL/min (normal)] | | | 0→※ | ※ | → | ※ | → | 190 |
| Internal pressure [Pa] | 40 | 80 | ※ | ※ | → | ※ | → | 80 |
| High-frequency power [W] | 400 | 800 | ※ | ※ | → | ※ | → | 750 |
| Substrate temperature [° C.] | 260 | 260 | 290 | 290 | 290 | 290 | 290 | 290 |
| Layer thickness [μm] | 3 | 25 | 0.20 | ※ | 0.10 | ※ | 0.15 | ※ |

TABLE 8

| Intermediate layer forming condition No. | Intermediate 7 | Intermediate 8 | Intermediate 9 | Intermediate 10 | Intermediate 11 | Intermediate 12 |
|---|---|---|---|---|---|---|
| $CH_4$ [mL/min (normal)] | 300 | 360 | 700 | 190 | 300 | 400 |
| Internal pressure (Pa) | 33 | 33 | 33 | 53 | 53 | 53 |
| High-frequency power (W) | 200 | 250 | 300 | 200 | 200 | 300 |
| Layer thickness (μm) | 0.03 | 0.03 | 0.03 | 0.02 | 0.02 | 0.02 |

TABLE 9

| Layer forming condition No. | | 9 | 10 | 11 |
|---|---|---|---|---|
| Intermediate layer | Constant layer 1 | Intermediate 7 | Intermediate 8 | Intermediate 9 |
| | Constant layer 2 | Intermediate 10 | Intermediate 11 | Intermediate 12 |

For the electrophotographic photosensitive member having a layer thickness of the surface layer of 2.00 μm formed according to example 2, the surface roughness was calculated as in example 1, thereafter, the adhesion was evaluated by using four electrophotographic photosensitive members, and the gradation and the sensitivity were evaluated by using the remaining one electrophotographic photosensitive member. Further, by the electrophotographic photosensitive member with a layer thickness of the surface layer of 0.05 μm formed according to example 2, the distributions of the carbon atomic ratio and the hydrogen atomic ratio in the layer thickness direction of the intermediate layer, C1, C2, H1, H2, C2–C1 and H2–H1 were obtained as in experimental example 1. Further, by the electrophotographic photosensitive member with a layer thickness of the surface layer of 0.30 μm formed according to example 2, the carbon atomic ratio, the hydrogen atomic ratio, the Si atomic density, the C atomic density and the Si+C atomic density in the surface layer were obtained by the analysis method which will be described later. The results are shown in Table 12.

(Carbon Atomic Ratio, Hydrogen Atomic Ratio, Si Atomic Density, C Atomic Density, Si+C Atomic Density)

First, a reference electrophotographic photosensitive member was produced in which only the charge injection inhibition layer and photoconductive layer were formed. Then, this was cut out in a square shape of 15 mm square at a middle portion thereof in its lengthwise direction at its arbitrary position in peripheral direction to prepare a reference sample.

Next, the electrophotographic photosensitive member in which the charge injection inhibition layer, the photoconductive layer and the surface layer were formed was likewise cut out to prepare a sample for measurement.

The reference sample and the sample for measurement were measured by spectroscopic ellipsometry (using a high-speed spectroscopic ellipsometer M-2000, manufactured by J.A. Woollam Co., Inc.) to determine the layer thickness of the surface layer.

Specific conditions for the measurement by spectroscopic ellipsometry are incident angles: 60°, 65° and 70°; measurement wavelength: 195 nm to 700 nm; and beam diameter: 1 mm×2 mm.

First, the reference sample was measured by spectroscopic ellipsometry to find the relationship between the wavelength and the amplitude ratio ψ and phase difference Δ at each incident angle.

Next, setting as a reference the results of measurement on the reference sample, the sample for measurement was measured in the same way as the reference sample by spectroscopic ellipsometry to determine the relationship between the wavelength and the amplitude ratio ψ and phase difference Δ at each incident angle.

Further, a layer structure in which the charge injection inhibition layer, the photoconductive layer and the surface layer were formed in this order and which had a roughness layer where the surface layer and a pneumatic layer were present together at the outermost surface was used as a calculation model, and, changing in volume ratio the surface layer and pneumatic layer of the roughness layer, the relationship between the wavelength and the ψ and Δ at each incident angle was found by calculation, using an analytical software. Then, a calculation model was picked out on which the relationship between the wavelength and the ψ and Δ at each incident angle that was found by this calculation and the relationship between the wavelength and the ψ and Δ at each incident angle that was found by measuring the sample for measurement came minimal in their mean square error. The layer thickness of the surface layer was calculated according to the calculation model thus picked out, and the value obtained was taken as the layer thickness of the surface layer. Here, WVASE 32, available from J.A. Woollam Co., Inc., was used as the analytical software. Also, in regard to the volume ratio of the surface layer and pneumatic layer of the roughness layer, the proportion of the pneumatic layer in the roughness layer, surface layer:pneumatic layer, was changed at intervals of 1 from 10:0 to 1:9 to make calculation. In the positive-charging a-Si electrophotographic photosensitive members produced in the present Example under the respective film forming conditions, the relationship between the wavelength and the ψ and Δ that was found by calculation and the relationship between the wavelength and the ψ and Δ that was found by measurement came minimal in their mean square error when the surface layer and the pneumatic layer were 8:2 in their volume ratio.

After the measurement made by spectroscopic ellipsometry was finished, the above sample for measurement was analyzed by RBS (Rutherford back scattering) (using a back scattering analyzer AN-2500, manufactured by Nisshin High Voltage Co., Ltd.) to measure the number of atoms of silicon atoms and number of atoms of carbon atoms in the surface layer within the area of measurement by RBS. The C/(Si+C) was found from the number of atoms of silicon atoms and number of atoms of carbon atoms thus measured. Next, for the silicon atoms and carbon atoms determined from the area of measurement by RBS, the Si atom density, the C atom density and the Si+C atom density were determined by using the layer thickness of surface layer that was determined by spectroscopic ellipsometry.

Simultaneously with the RBS, the sample for measurement was analyzed by HFS (hydrogen forward scattering) (using a back scattering analyzer AN-2500, manufactured by Nisshin High Voltage Co., Ltd.) to measure the number of atoms of hydrogen atoms in the surface layer within the area of measurement by HFS. The H/(Si+C+H) was found according to the number of atoms of hydrogen atoms determined from the area of measurement by HFS and the number of atoms of silicon atoms and number of atoms of carbon atoms determined from the measurement by RBS.

Next, for the number of atoms of hydrogen atoms determined from the area of measurement by HFS, the H atom density was determined by using the layer thickness of surface layer that was determined by spectroscopic ellipsometry.

Specific conditions for the measurement by RBS and HFS were incident ions: $4He^+$, incident energy: 2.3 MeV, incident angle: 75°, sample electric current: 35 nA, and incident beam diameter: 1 mm; as a detector for the RBS, scattering angle: 160°, and aperture diameter: 8 mm; and as a detector for the HFS, recoil angle: 30°, and aperture diameter: 8 mm+Slit; under which the measurement was made.

Comparative Example 2

Similarly to example 2, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 7. At this time, the intermediate layers were formed under the conditions described in the layer forming condition No. shown in the following Table 11 by using the intermediate layer forming conditions shown in the following Table 10, and six positively chargeable a-Si photosensitive members were produced under the respective layer forming conditions. Further, the layer thickness of the surface layer was formed by being adjusted to be 2.00 μm for five of the produced electrophotographic photosensitive members and 0.05 μm for the remaining one.

TABLE 10

| Intermediate layer forming condition No. | Intermediate 13 | Intermediate 14 | Intermediate 15 | Intermediate 16 |
|---|---|---|---|---|
| $CH_4$ [mL/min (normal)] | 320 | 700 | 160 | 500 |
| Internal pressure (Pa) | 33 | 33 | 53 | 53 |
| High-frequency power (W) | 150 | 350 | 150 | 300 |
| Layer thickness (μm) | 0.03 | 0.03 | 0.02 | 0.02 |

TABLE 11

| Layer forming condition No. | | 12 | 13 |
|---|---|---|---|
| Intermediate layer | Constant layer 1 | Intermediate 13 | Intermediate 14 |
| | Constant layer 2 | Intermediate 15 | Intermediate 16 |

With respect to the electrophotographic photosensitive member produced according to comparative example 2, the surface roughness was calculated, and thereafter, the distributions of the carbon atomic ratio and the hydrogen atomic ratio in the layer thickness direction in the intermediate layer, C1, C2, H1, H2, C2−C1 and H2−H1 were obtained as in example 2, whereby the adhesion, gradation and sensitivity were evaluated. The results are shown in Table 12. The measurement results and the evaluation results in example 2 and comparative example 2 are shown in Table 12.

TABLE 12

| | Layer forming condition | Intermediate layer | | | | | | | | |
|---|---|---|---|---|---|---|---|---|---|---|
| | | Carbon atomic ratio | | Hydrogen atomic ratio | | | | | | |
| | No. | C1 | C2 | H1 | H2 | C2 − C1 | H2 − H1 | Adhesion | Gradation | Sensitivity |
| Com. Ex. 2 | 12 | 0.50 | 0.47 | 0.33 | 0.38 | −0.03 | 0.05 | A | D | A |
| Ex. 2 | 9 | 0.53 | 0.50 | 0.32 | 0.37 | −0.03 | 0.05 | A | A | A |
| | 10 | 0.56 | 0.54 | 0.32 | 0.38 | −0.02 | 0.06 | A | A | A |
| | 11 | 0.63 | 0.60 | 0.33 | 0.38 | −0.03 | 0.05 | A | A | A |
| Com. Ex. 2 | 13 | 0.65 | 0.62 | 0.33 | 0.39 | −0.03 | 0.06 | A | A | C |

The distributions in the layer thickness direction of the carbon atomic ratios and the hydrogen atomic ratios in the intermediate layers of example 2 and comparative example 2 were distributions similar to FIG. 1A. Further, the largest value of the maximum region in the layer thickness direction of the carbon atomic ratio in the intermediate layer was located in the constant layer 1. The smallest value of the minimum region in the layer thickness direction of the carbon atomic ratio and the largest value of the maximum region in the layer thickness direction of the hydrogen atomic ratio in the intermediate layer were located in the constant layer 2. From the results of Table 12, by setting the largest value of the carbon atomic ratio of the maximum region of the distribution in the layer thickness direction of the carbon atomic ratio in the intermediate layer at 0.53 to 0.63 inclusive, the electrophotographic photosensitive member with favorable gradation and sensitively was able to be produced. The Si+C atomic density of the surface layer used in each of example 2 and comparative example 2 was $7.73\times10^{22}$ atom/cm$^3$. This shows that by setting the distributions in the layer thickness direction of the carbon atomic ratio and the hydrogen atomic ratio in the intermediate layer as in FIG. 1A, favorable adhesion can be obtained even when a high-density surface layer is formed. Further, the carbon atomic ratio was 0.67 and the hydrogen atomic ratio was 0.03 in the surface layer. As for the surface roughness of the electrophotographic photosensitive members produced in example 2 and comparative example 2, Ra was in the range of 32 nm to 36 nm inclusive, and Δa was in the range of 0.13 to 0.16 inclusive.

Example 3

Similarly to example 2, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 13. At this time, the intermediate layers were formed under the conditions described in the layer forming condition No. shown in the following Table 15 by using the intermediate layer forming conditions shown in the following Table 14, and six positively chargeable a-Si photosensitive members were produced under the respective layer forming conditions. Further, the layer thickness of the surface layer was formed by being adjusted to be 2.00 μm for five of the produced electrophotographic photosensitive members, and 0.05 μm for the remaining one.

TABLE 14

| Intermediate layer forming condition No. | Intermediate 17 | Intermediate 18 | Intermediate 19 | Intermediate 20 |
|---|---|---|---|---|
| $CH_4$ [mL/min (normal)] | 190 | 190 | 260 | 190 |
| Internal pressure (Pa) | 33 | 53 | 53 | 53 |
| High-frequency power (W) | 350 | 150 | 150 | 300 |
| Layer thickness (μm) | 0.03 | 0.02 | 0.02 | 0.02 |

TABLE 15

| Layer forming condition No. | | 14 | 15 | 16 |
|---|---|---|---|---|
| Intermediate layer | Constant layer 1 | Intermediate 17 | Intermediate 17 | Intermediate 17 |
| | Constant layer 2 | Intermediate 18 | Intermediate 19 | Intermediate 20 |

With respect to the electrophotographic photosensitive member produced according to example 3, the surface roughness was calculated, thereafter, the distributions of the carbon atomic ratio and the hydrogen atomic ratio in the layer thickness direction in the intermediate layer, C1, C2, H1, H2, C2–C1 and H2–H1 were obtained as in example 2, whereby the adhesion, gradation and sensitivity were evaluated. The results are shown in Table 18.

Comparative Example 3

Similarly to example 3, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 13. At this time, the intermediate layers were formed under the conditions described in the layer forming condition No. shown in the following Table 17 by using the intermediate layer forming conditions shown in the following Table 16, and six positively chargeable a-Si photosensitive members were produced under the respective layer forming conditions. Further, the layer thickness of the surface layer was formed by being adjusted to be 2.00 μm for five of the produced electrophotographic photosensitive members and 0.05 μm for the remaining one.

TABLE 13

| | | | Intermediate layer | | | | | |
|---|---|---|---|---|---|---|---|---|
| | Charge injection inhibition layer | Photoconductive layer | Variable layer 1 | Constant layer 1 | Variable layer 2 | Constant layer 2 | Variable layer 3 | Surface layer |
| Gas species and flow rate | | | | | | | | |
| $SiH_4$ [mL/min (normal)] | 350 | 450 | 26 | 26 | → | 26 | → | 26 |
| $H_2$ [mL/min (normal)] | 750 | 2200 | | | | | | |
| $B_2H_6$ [ppm] (vs. $SiH_4$) | 1500 | 1 | | | | | | |
| NO [mL/min (normal)] | 10 | | | | | | | |
| $CH_4$ [mL/min (normal)] | | | 0→※ | ※ | → | ※ | → | 320 |
| Internal pressure [Pa] | 40 | 80 | ※ | ※ | → | ※ | → | 80 |
| High-frequency power [W] | 400 | 800 | ※ | ※ | → | ※ | → | 700 |
| Substrate temperature [° C.] | 260 | 260 | 290 | 290 | 290 | 290 | 290 | 290 |
| Layer thickness [μm] | 3 | 25 | 0.20 | ※ | 0.10 | ※ | 0.15 | ※ |

TABLE 16

| Intermediate layer forming condition No. | Interme-diate 17 | Interme-diate 21 | Interme-diate 22 |
|---|---|---|---|
| $CH_4$ [mL/min (normal)] | 190 | 140 | 260 |
| Internal pressure (Pa) | 33 | 53 | 53 |
| High-frequency power (W) | 350 | 150 | 300 |
| Layer thickness (μm) | 0.03 | 0.02 | 0.02 |

TABLE 17

| Layer forming condition No. | | 17 | 18 |
|---|---|---|---|
| Intermediate layer | Constant layer 1 | Intermediate 17 | Intermediate 17 |
| | Constant layer 2 | Intermediate 21 | Intermediate 22 |

With respect to the electrophotographic photosensitive member produced according to comparative example 3, the surface roughness was calculated, and thereafter, the distributions of the carbon atomic ratio and the hydrogen atomic ratio in the layer thickness direction in the intermediate layer, C1, C2, H1, H2, C2–C1 and H2–H1 were obtained as in example 2, whereby the adhesion, gradation and sensitivity were evaluated. The results are shown in Table 18. The measurement results and the evaluation results in example 3 and comparative example 3 are shown in Table 18.

TABLE 18

| | Layer forming condition No. | Intermediate layer: Carbon atomic ratio C1 | C2 | Hydrogen atomic ratio H1 | H2 | C2 – C1 | H2 – H1 | Adhe-sion | Grada-tion | Sensi-tivity |
|---|---|---|---|---|---|---|---|---|---|---|
| Com. Ex. 3 | 17 | 0.55 | 0.45 | 0.30 | 0.42 | −0.10 | 0.12 | A | D | A |
| Ex. 3 | 14 | 0.55 | 0.47 | 0.30 | 0.42 | −0.08 | 0.12 | A | B | A |
| | 15 | 0.55 | 0.49 | 0.30 | 0.42 | −0.06 | 0.12 | A | A | A |
| | 16 | 0.55 | 0.54 | 0.30 | 0.42 | −0.01 | 0.12 | A | A | A |
| Com. Ex. 3 | 18 | 0.55 | 0.57 | 0.30 | 0.42 | 0.02 | 0.12 | A | D | A |

Figure 2C:
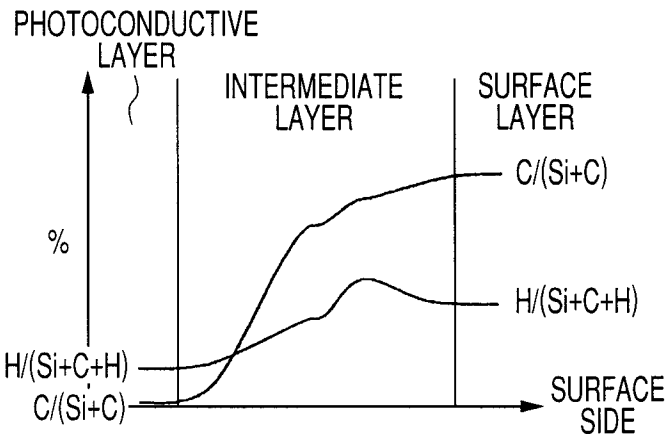
FIG. 2C is a diagram illustrating the distributions in the layer thickness direction of the carbon atomic ratio and the hydrogen atomic ratio of the intermediate layer of the comparative example.
Figure 2D:
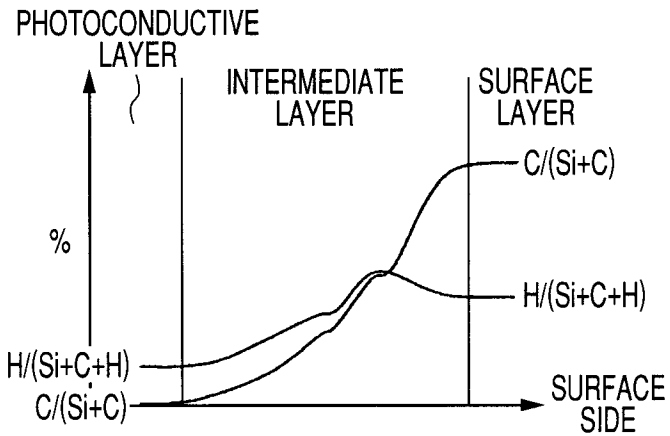
FIG. 2D is a diagram illustrating the distributions in the layer thickness direction of the carbon atomic ratio and the hydrogen atomic ratio of the intermediate layer of the comparative example.

The distributions in the layer thickness direction of the carbon atomic ratios and the hydrogen atomic ratios in the intermediate layers of example 3 and comparative example 3 were distributions similar to FIG. 1A in the layer forming condition Nos. 14 to 17, and were distributions similar to FIG. 2C in the layer forming condition No. 18. The region from the variable layer 1 to the constant layer 1 in the layer forming condition No. 18 was similar to the regions from the variable layers 1 to the constant layers 1 in the layer forming condition Nos. 14 to 17. From the results of Table 18, when the largest value of the carbon atomic ratio of the maximum region of the distribution of the carbon atomic ratio in the intermediate layer was set as C1, and the smallest value of the carbon atomic ratio in the minimum region of the distribution of the carbon atomic ratio in the intermediate layer was set as C2, favorable gradation was obtained by setting C2 to be smaller than C1 and at 0.47 or more. Further, by setting C2–C1 at −0.06 to −0.01 inclusive, more favorable gradation was obtained.

The surface layers used in example 3 and comparative example 3 were formed in the layer forming conditions similar to example 1. The Si+C atomic density of the surface layer was $7.04\times10^{22}$ atom/cm$^3$. This shows that by setting the distributions in the layer thickness direction of the carbon atomic ratio and the hydrogen atomic ratio in the intermediate layer as in FIG. 1A, favorable adhesion can be obtained even when a high-density surface layer is formed. Further, the carbon atomic ratio was 0.71 and the hydrogen atomic ratio was 0.39 in the surface layer. As for the surface roughness of the electrophotographic photosensitive members produced in example 3 and comparative example 3, Ra was in the range of 32 nm to 36 nm inclusive, and Δa was in the range of 0.13 to 0.16 inclusive.

Example 4

Similarly to example 2, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 19. At this time, the intermediate layers were formed under the conditions described in the layer forming condition No. shown in the following Table 21 by using the intermediate layer forming conditions shown in the following Table 20, and six positively chargeable a-Si photosensitive members were produced under the respective layer forming conditions. Further, the layer thickness of the surface layer was formed by being adjusted to be 2.00 μm for five of the produced electrophotographic photosensitive members, and 0.05 μm for the remaining one.

TABLE 19

| | Charge injection inhibition layer | Photoconductive layer | Intermediate layer: Variable layer 1 | Constant layer 1 | Variable layer 2 | Constant layer 2 | Variable layer 3 | Surface layer |
|---|---|---|---|---|---|---|---|---|
| Gas species and flow rate | | | | | | | | |
| $SiH_4$ [mL/min (normal)] | 350 | 450 | 26 | 26 | → | 26 | → | 26 |
| $H_2$ [mL/min (normal)] | 750 | 2200 | | | | | | |
| $B_2H_6$ [ppm] (vs. $SiH_4$) | 1500 | 1 | | | | | | |
| NO [mL/min (normal)] | 10 | | | | | | | |

TABLE 19-continued

| | Charge injection inhibition layer | Photoconductive layer | Intermediate layer: Variable layer 1 | Constant layer 1 | Variable layer 2 | Constant layer 2 | Variable layer 3 | Surface layer |
|---|---|---|---|---|---|---|---|---|
| $CH_4$ [mL/min (normal)] | | | 0→※ | ※ | → | ※ | → | 190 |
| Internal pressure [Pa] | 40 | 80 | ※ | ※ | → | ※ | → | 80 |
| High-frequency power [W] | 400 | 800 | ※ | ※ | → | ※ | → | 750 |
| Substrate temperature [° C.] | 260 | 260 | 290 | 290 | 290 | 290 | 290 | 290 |
| Layer thickness [μm] | 3 | 25 | 0.20 | ※ | 0.10 | ※ | 0.15 | ※ |

TABLE 20

| | Intermediate layer forming condition No. | | | | | |
|---|---|---|---|---|---|---|
| | Intermediate 23 | Intermediate 24 | Intermediate 25 | Intermediate 26 | Intermediate 27 | Intermediate 28 |
| $CH_4$ [mL/min (normal)] | 700 | 450 | 400 | 240 | 300 | 360 |
| Internal pressure (Pa) | 33 | 53 | 67 | 80 | 80 | 80 |
| High-frequency power (W) | 300 | 300 | 300 | 400 | 350 | 300 |
| Layer thickness (μm) | 0.03 | 0.02 | 0.02 | 0.02 | 0.02 | 0.02 |

TABLE 21

| Layer forming condition No. | | 19 | 20 | 21 | 22 | 23 |
|---|---|---|---|---|---|---|
| Intermediate layer | Constant layer 1 | Intermediate 23 | Intermediate 23 | Intermediate 23 | Intermediate 23 | Intermediate 23 |
| | Constant layer 2 | Intermediate 24 | Intermediate 25 | Intermediate 26 | Intermediate 27 | Intermediate 28 |

With respect to the electrophotographic photosensitive member produced according to example 4, the surface roughness was calculated, thereafter, the distributions of the carbon atomic ratio and the hydrogen atomic ratio in the layer thickness direction in the intermediate layer, C1, C2, H1, H2, C2–C1 and H2–H1 were obtained as in example 2, whereby the adhesion, gradation and sensitivity were evaluated. The results are shown in Table 24.

Comparative Example 4

Similarly to example 4, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 19. At this time, the intermediate layers were formed under the conditions described in the layer forming condition No. shown in the following Table 23 by using the intermediate layer forming conditions shown in the following Table 22, and six positively chargeable a-Si photosensitive members were produced under the respective layer forming conditions. Further, the layer thickness of the surface layer was formed by being adjusted to be 2.00 μm for five of the produced electrophotographic photosensitive members and 0.05 μm for the remaining one.

TABLE 22

| Intermediate layer forming condition No. | Intermediate 23 | Intermediate 29 |
|---|---|---|
| $CH_4$ [mL/min (normal)] | 700 | 450 |
| Internal pressure (Pa) | 33 | 33 |
| High-frequency power (W) | 300 | 300 |
| Layer thickness (μm) | 0.03 | 0.02 |

TABLE 23

| Layer forming condition No. | | 24 |
|---|---|---|
| Intermediate layer | Constant layer 1 | Intermediate 23 |
| | Constant layer 2 | Intermediate 29 |

With respect to the electrophotographic photosensitive member produced according to comparative example 4, the surface roughness was calculated, and thereafter, the distributions of the carbon atomic ratio and the hydrogen atomic ratio in the layer thickness direction in the intermediate layer, C1, C2, H1, H2, C2–C1 and H2–H1 were obtained as in example 2, whereby the adhesion, gradation and sensitivity were evaluated. The results are shown in Table 24.

The measurement result and the evaluation result in example 4 and comparative example 4 are shown in Table 24.

TABLE 24

| | Layer forming condition No. | Intermediate layer: Carbon atomic ratio C1 | C2 | Hydrogen atomic ratio H1 | H2 | C2 − C1 | H2 − H1 | Adhesion | Gradation | Sensitivity |
|---|---|---|---|---|---|---|---|---|---|---|
| Com. Ex. 4 | 24 | 0.63 | 0.61 | 0.33 | 0.33 | −0.02 | 0.00 | D | A | A |
| Ex. 4 | 19 | 0.63 | 0.61 | 0.33 | 0.38 | −0.02 | 0.05 | A | A | A |
| | 20 | 0.63 | 0.61 | 0.33 | 0.45 | −0.02 | 0.12 | A | A | A |
| | 21 | 0.63 | 0.61 | 0.33 | 0.48 | −0.02 | 0.15 | A | A | A |
| | 22 | 0.63 | 0.61 | 0.33 | 0.50 | −0.02 | 0.17 | A | B | A |
| | 23 | 0.63 | 0.61 | 0.33 | 0.52 | −0.02 | 0.19 | A | C | A |

The distributions in the layer thickness direction of the carbon atomic ratios and the hydrogen atomic ratios in the intermediate layers of example 4 and comparative example 4 in the layer forming condition Nos. 19 to 23 were distributions similar to FIG. 1A, and those in the layer forming condition No. 24 were distributions similar to FIG. 2A. The region from the variable layer 1 to the constant layer 1 in the layer forming condition No. 24 was similar to the regions from the variable layer 1 to the constant layer 1 in the layer forming condition Nos. 19 to 23. From the result of Table 24, by setting the largest value H2 of the hydrogen atomic ratio in the maximum region of the distribution of the hydrogen atomic ratio in the intermediate layer at 0.50 or less, the electrophotographic photosensitive member with favorable gradation was obtained. Further, by setting H2−H1 in the intermediate layer at 0.05 to 0.15 inclusive, the electrophotographic photosensitive member with more favorable gradation was obtained. The hydrogen atomic ratio at the position of the largest value C1 of the carbon atomic ratio in the maximum region of the distribution of the carbon atomic ratio was set as H1, and the largest value of the hydrogen atomic ratio in the maximum region of the distribution of the hydrogen atomic ratio in the intermediate layer was set as H2. The surface layers used in example 4 and comparative example 4 are formed in the layer forming conditions similar to example 2. The Si+C atomic density of the surface layer was $7.73\times10^{22}$ atom/cm$^3$. This shows that by setting the distributions in the layer thickness direction of the carbon atomic ratio and the hydrogen atomic ratio in the intermediate layer as in FIG. 1A, favorable adhesion can be obtained even when a high-density surface layer is formed. Further, the carbon atomic ratio was 0.67 and the hydrogen atomic ratio was 0.30 in the surface layer. As for the surface roughness of the electrophotographic photosensitive members produced in example 4 and comparative example 4, Ra was in the range of 32 nm to 36 nm inclusive, and Δa was in the range of 0.13 to 0.16 inclusive.

Example 5

Similarly to example 2, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 25. At this time, the layer formation time was regulated so that each of the layer thicknesses of the variable layer 2, the constant layer 2 and the variable layer 3 became the condition shown in the following Table 26, and six positively chargeable a-Si photosensitive members were produced under the respective layer forming conditions. Further, the layer thickness of the surface layer was formed by being adjusted to be 2.00 μm for five of the produced electrophotographic photosensitive members, and 0.05 μm for the remaining one.

TABLE 25

| | Charge injection inhibition layer | Photoconductive layer | Intermediate layer: Variable layer 1 | Constant layer 1 | Variable layer 2 | Constant layer 2 | Variable layer 3 | Surface layer |
|---|---|---|---|---|---|---|---|---|
| Gas species and flow rate | | | | | | | | |
| $SiH_4$ [mL/min (normal)] | 350 | 450 | 26 | 26 | → | 26 | → | 26 |
| $H_2$ [mL/min (normal)] | 750 | 2200 | | | | | | |
| $B_2H_6$ [ppm] (vs. $SiH_4$) | 1500 | 1 | | | | | | |
| NO [mL/min (normal)] | 10 | | | | | | | |
| $CH_4$ [mL/min (normal)] | | | 0→ | 600 | → | 320 | → | 320 |
| Internal pressure [Pa] | 40 | 80 | 33 | 33 | → | 67 | → | 80 |
| High-frequency power [W] | 400 | 800 | 300 | 300 | → | 300 | → | 700 |
| Substrate temperature [° C.] | 260 | 260 | 260→290 | 290 | 290 | 290 | 290 | 290 |
| Layer thickness [μm] | 3 | 25 | 0.20 | 0.03 | ※ | ※ | ※ | ※ |

TABLE 26

| Layer forming condition No. | 25 | 26 | 27 | 28 | 29 | 30 |
|---|---|---|---|---|---|---|
| Variable layer 2 layer thickness (μm) | 0.004 | 0.004 | 0.03 | 0.10 | 0.20 | 0.25 |
| Constant layer 2 layer thickness (μm) | 0.000 | 0.02 | 0.02 | 0.02 | 0.02 | 0.02 |
| Variable layer 3 layer thickness (μm) | 0.006 | 0.006 | 0.05 | 0.18 | 0.28 | 0.43 |

With respect to the electrophotographic photosensitive member produced according to example 5, the surface roughness was calculated, thereafter, the distributions of the carbon atomic ratio and the hydrogen atomic ratio in the layer thickness direction in the intermediate layer, C1, C2, H1, H2, C2−C1 and H2−H1 were obtained, as in example 2, whereby the adhesion, gradation and sensitivity were evaluated. The results are shown in Table 27.

TABLE 27

| Layer forming condition No. | Intermediate layer: Layer thickness (μm) Variable layer 2 | Constant layer 2 | Variable layer 3 | Total | d2/d1 | Carbon atomic ratio C1 | C2 | Hydrogen atomic ratio H1 | H2 | C2 − C1 | H2 − H1 | Adhesion | Gradation | Sensitivity |
|---|---|---|---|---|---|---|---|---|---|---|---|---|---|---|
| Ex. 5 25 | 0.004 | 0.000 | 0.006 | 0.01 | 0.005 | 0.62 | 0.60 | 0.33 | 0.45 | −0.02 | 0.12 | C | A | A |
| 26 | 0.004 | 0.02 | 0.006 | 0.03 | 0.015 | 0.62 | 0.60 | 0.33 | 0.45 | −0.02 | 0.12 | B | A | A |
| 27 | 0.03 | 0.02 | 0.05 | 0.1 | 0.05 | 0.62 | 0.60 | 0.33 | 0.45 | −0.02 | 0.12 | A | A | A |
| 28 | 0.10 | 0.02 | 0.18 | 0.30 | 0.15 | 0.62 | 0.60 | 0.33 | 0.45 | −0.02 | 0.12 | A | A | A |
| 29 | 0.20 | 0.02 | 0.28 | 0.50 | 0.25 | 0.62 | 0.60 | 0.33 | 0.45 | −0.02 | 0.12 | A | A | A |
| 30 | 0.25 | 0.02 | 0.43 | 0.70 | 0.35 | 0.62 | 0.60 | 0.33 | 0.45 | −0.02 | 0.12 | A | A | B |

The distributions in the layer thickness direction of the carbon atomic ratio and the hydrogen atomic ratio in the intermediate layer of example 5 were distributions similar to FIG. 1A. From the results of Table 27, by setting the distance d2 from the maximum region of the distribution of the carbon atomic ratio in the intermediate layer to the surface layer at 300 angstroms or more, adhesion was more enhanced. Further, by setting the ratio (d2/d1) of the distance d2 from the maximum region of the distribution of the carbon atomic ratio in the intermediate layer to the surface layer to the layer thickness d1 of the surface layer at 0.05 or more, adhesion was further enhanced. Further, by setting the distance d2 from the maximum region of the distribution of the carbon atomic ratio in the intermediate layer to the surface layer at 7000 angstroms or less, favorable sensitivity was obtained. The surface layer used in example 5 was formed in the layer forming conditions similar to experimental example 1. The Si+C atomic density of the surface layer was $7.04\times10^{22}$ atom/$cm^3$. This shows that by setting the distributions in the layer thickness direction of the carbon atomic ratio and the hydrogen atomic ratio in the intermediate layer as in FIG. 1A, favorable adhesion can be obtained even when a high-density surface layer is formed. Further, the carbon atomic ratio was 0.71 and the hydrogen atomic ratio was 0.39 in the surface layer. As for the surface roughness of the electrophotographic photosensitive members produced in example 5, Ra was in the range of 32 nm to 36 nm inclusive, and Δa was in the range of 0.13 to 0.16 inclusive.

Example 6

Similarly to example 2, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the following Table 28. At this time, the high-frequency power, the flow rates of $SiH_4$ and $CH_4$ and the internal pressure at the time of formation of the surface layer were set as those in the layer forming conditions shown in the following Table 29, and six positively chargeable a-Si photosensitive members were produced under the respective layer forming conditions. Further, the layer thickness of the surface layer was formed by being adjusted to be 2.00 μm for five of the produced electrophotographic photosensitive members, and 0.30 μm for the remaining one.

TABLE 28

| | Charge injection inhibition layer | Photoconductive layer | Intermediate layer: Variable layer 1 | Constant layer 1 | Variable layer 2 | Constant layer 2 | Variable layer 3 | Surface layer |
|---|---|---|---|---|---|---|---|---|
| Gas species and flow rate | | | | | | | | |
| $SiH_4$ [mL/min (normal)] | 350 | 450 | 26 | 26 | → | 26 | → | ※ |
| $H_2$ [mL/min (normal)] | 750 | 2200 | | | | | | |
| $B_2H_6$ [ppm] (vs. $SiH_4$) | 1500 | 1 | | | | | | |
| NO [mL/min (normal)] | 10 | | | | | | | |
| $CH_4$ [mL/min (normal)] | | | 0→ | 600 | → | 320 | → | ※ |
| Internal pressure [Pa] | 40 | 80 | 33 | 33 | → | 67 | → | ※ |
| High-frequency power [W] | 400 | 800 | 300 | 300 | → | 300 | → | ※ |
| Substrate temperature [° C.] | 260 | 260 | 290 | 290 | 290 | 290 | 290 | 290 |
| Layer thickness [μm] | 3 | 25 | 0.20 | 0.03 | 0.10 | 0.02 | 0.15 | ※ |

TABLE 29

| Layer forming condition No. | 31 | 32 | 33 | 34 |
|---|---|---|---|---|
| $SiH_4$ [mL/min (normal)] | 26 | 26 | 26 | 26 |
| $CH_4$ [mL/min (normal)] | 1400 | 500 | 400 | 360 |
| High-frequency power (W) | 400 | 800 | 750 | 700 |
| Internal pressure (Pa) | 55 | 80 | 80 | 80 |

With respect to the electrophotographic photosensitive member with the layer thickness of the surface layer of 2.00 μm which was formed according to example 6, the surface roughness was calculated as in example 2, and thereafter, the adhesion was evaluated by using four electrophotographic photosensitive members. Subsequently, the gradation and sensitivity were evaluated as in example 2 by using the remaining one electrophotographic photosensitive member, and thereafter, the wear resistance was evaluated under the evaluation conditions which will be described later. By using the electrophotographic photosensitive member with the layer thickness of the surface layer of 0.30 μm which was formed according to example 6, the carbon atomic ratio, the hydrogen atomic ratio, the Si atomic density, the C atomic density and the Si+C atomic density were obtained as in experimental example 2. The results are shown in Table 30.

(Wear Resistance Evaluation)

The evaluation method of the wear resistance is such that the layer thickness of the surface layer of the electrophotographic photosensitive member immediately after being produced was measured at 18 points in total, that are the nine points in the longitudinal direction in an arbitrary circumferential direction of the electrophotographic photosensitive member (0 mm, ±50 mm, ±90 mm, ±130 mm, ±150 mm with the center in the longitudinal direction of the electrophotographic photosensitive member as the reference), and the nine points in the longitudinal direction at the position rotated by 180° from the aforementioned arbitrary circumferential direction, and was calculated based on the average value of the values at 18 points. As the measurement method, the surface of the electrophotographic photosensitive member was vertically irradiated with light with the spot diameter of 2 mm, and spectrometry of the reflection light was performed by using a spectrometer (MCPD-2000 made by Otsuka Electronics Co., Ltd.). The layer thickness of the surface layer was calculated based on the obtained reflection waveform. At this time, the wavelength range was set at 500 nm to 750 nm inclusive, and the refractive index of the photoconductive layer was set at 3.30, and as the refractive index of the surface layer, the value was used, which was obtained by measurement of the spectroscopic ellipsometry which was performed at the time of the aforementioned measurement of the Si+C atomic density.

Figure 6:
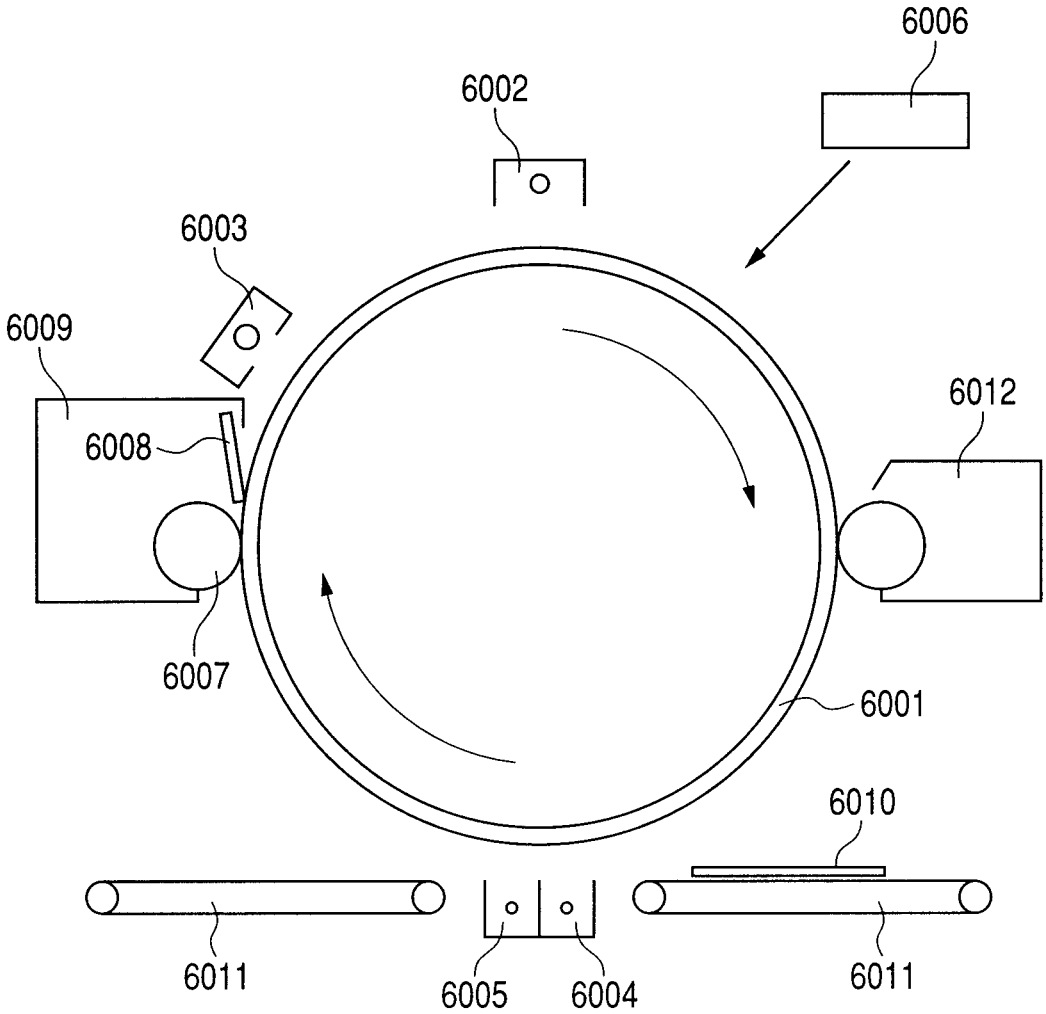
FIG. 6 is a view illustrating one example of an electrophotographic apparatus having the a-Si photosensitive member.

After the measurement of the layer thickness, the electrophotographic photosensitive member was placed in the electrophotographic apparatus having the constitution as shown in FIG. 6, more concretely, the digital electrophotographic apparatus iR-5065 made by Canon Inc. under the highly humid environment at a temperature of 25° C. and a relative humidity of 75% (volume absolute humidity of 17.3 g/cm$^3$), and the continuous paper feeding test was carried out. The continuous paper feeding test was carried out under the condition that the photosensitive member heater was always off all through the time in which the electrophotographic apparatus was operated and the continuous paper feeding test was carried out, and the time in which the electrophotographic apparatus was stopped. In more concrete, by using the test pattern of A4 with a print ratio of 1%, the continuous paper feeding test of 25000 sheets per day was carried out for ten days to perform continuous paper feeding test of 250000 sheets. After the continuous paper feeding test of 250000 sheets was finished, the electrophotographic photosensitive member was taken out of the electrophotographic apparatus. The layer thickness was measured at the same position as that at the time immediately after production, and the layer thickness of the surface layer after being subjected to the continuous paper feeding test was calculated in the same manner as immediately after production. The difference was obtained from the average layer thicknesses of the surface layer obtained immediately after production and after the continuous paper feeding test, and the wear amount in the continuous paper feeding test of 250000 sheets was calculated. The wear resistance was evaluated by relative comparison. In the relative comparison, the difference of the average layer thicknesses of the surface layer obtained immediately after production and after the continuous paper feeding test of the electrophotographic photosensitive member in the layer forming condition No. 31 produced in example 6 was set as 1.00.

A. The ratio of the difference of the average layer thicknesses of the surface layer of the electrophotographic photosensitive member produced in each of the layer forming conditions to the difference of the average layer thicknesses of the surface layer of the electrophotographic photosensitive member in the layer forming condition No. 31 produced in example 6 is 0.06 or less.

B. The ratio of the difference of the average layer thicknesses of the surface layer of the electrophotographic photosensitive member produced in each of the layer forming conditions to the difference of the average layer thicknesses of the surface layer of the electrophotographic photosensitive member in the layer forming condition No. 31 produced in example 6 is more than 0.06 and 0.70 or less.

C. The ratio of the difference of the average layer thicknesses of the surface layer of the electrophotographic photosensitive member produced in each of the layer forming conditions to the difference of the average layer thicknesses of the surface layer of the electrophotographic photosensitive member in the layer forming condition No. 31 produced in example 6 is more than 0.70 and 0.80 or less.

D. The ratio of the difference of the average layer thicknesses of the surface layer of the electrophotographic photosensitive member produced in each of the layer forming conditions to the difference of the average layer thicknesses of the surface layer of the electrophotographic photosensitive member in the layer forming condition No. 31 produced in example 6 is more than 0.80 and 0.90 or less.

E. The ratio of the difference of the average layer thicknesses of the surface layer of the electrophotographic photosensitive member produced in each of the layer forming conditions to the difference of the average layer thicknesses of the surface layer of the electrophotographic photosensitive member in the layer forming condition No. 31 produced in example 6 is more than 0.90 and 1.00 or less.

F. The ratio of the difference of the average layer thicknesses of the surface layer of the electrophotographic photosensitive member produced in each of the layer forming conditions to the difference of the average layer thicknesses of the surface layer of the electrophotographic photosensitive member in the layer forming condition No. 31 produced in example 6 is more than 1.00.

With respect to the electrophotographic photosensitive member produced according to example 6, the surface roughness was calculated, thereafter, the carbon atomic ratio, the hydrogen atomic ratio, the Si atomic density, the C atomic density and the Si+C atomic density of the surface layer were obtained, and the wear resistance, adhesion, gradation and sensitivity were evaluated as in example 2. The results are shown in Table 30.

TABLE 30

| | Layer forming condition No. | Surface layer: Carbon atomic ratio | Si atomic density ($10^{22}$ atom/cm$^3$) | C atomic density ($10^{22}$ atom/cm$^3$) | Si + C atomic density ($10^{22}$ atom/cm$^3$) | Hydrogen atomic ratio | Adhesion | Wear resistance | Gradation | Sensitivity |
|---|---|---|---|---|---|---|---|---|---|---|
| Ex. 6 | 31 | 0.69 | 2.00 | 4.45 | 6.45 | 0.39 | A | E | A | A |
| | 32 | 0.75 | 1.65 | 4.95 | 6.60 | 0.43 | A | B | A | A |

TABLE 30-continued

| Layer forming condition No. | Surface layer: Carbon atomic ratio | Si atomic density ($10^{22}$ atom/cm$^3$) | C atomic density ($10^{22}$ atom/cm$^3$) | Si + C atomic density ($10^{22}$ atom/cm$^3$) | Hydrogen atomic ratio | Adhesion | Wear resistance | Gradation | Sensitivity |
|---|---|---|---|---|---|---|---|---|---|
| 33 | 0.73 | 1.84 | 4.97 | 6.81 | 0.41 | A | A | A | A |
| 34 | 0.72 | 1.93 | 4.97 | 6.90 | 0.41 | A | A | A | A |

The distributions in the layer thickness direction of the carbon atomic ratio and the hydrogen atomic ratio in the intermediate layer of example 6 were the same as those in the layer forming condition No. 3 of example 1, and were the distributions similar to FIG. 1A. From the results of Table 30, it has been found out that by setting the Si+C atomic density in the surface layer at $6.60\times10^{22}$ atom/cm$^3$ or more, the electrophotographic photosensitive member excellent in wear resistance can be obtained. It has been found out that by setting the Si+C atomic density in the surface layer at $6.81\times10^{22}$ atom/cm$^3$ or more, the electrophotographic photosensitive member more excellent in wear resistance can be obtained. It has been found out that by setting the distributions in the layer thickness direction of the carbon atomic ratio and the hydrogen atomic ratio in the intermediate layer as in FIG. 1A, favorable adhesion can be obtained even when a high-density surface layer is formed. By forming the high-density surface layer, a long-life electrophotographic photosensitive member was obtained by enhancement in wear resistance. As for the surface roughness of the electrophotographic photosensitive members produced in example 6, Ra was in the range of 32 nm to 36 nm inclusive, and Δa was in the range of 0.13 to 0.16 inclusive.

Example 7

Similarly to example 6, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the above described Table 28. At this time, the high-frequency power, and the flow rates of $SiH_4$ and $CH_4$ at the time of formation of the surface layer were set as those in the layer forming conditions shown in the following Table 31, and six positively chargeable a-Si photosensitive members were produced under the respective layer forming conditions. Further, the layer thickness of the surface layer was formed by being adjusted to be 2.00 μm for five of the produced electrophotographic photosensitive members, and 0.03 μm for the remaining one.

TABLE 31

| Layer forming condition No. | 35 | 36 | 37 | 38 | 39 | 40 |
|---|---|---|---|---|---|---|
| $SiH_4$ [mL/min (normal)] | 35 | 35 | 26 | 26 | 26 | 26 |
| $CH_4$ [mL/min (normal)] | 190 | 190 | 190 | 400 | 400 | 450 |
| High-frequency power (W) | 700 | 750 | 700 | 800 | 900 | 900 |
| Internal pressure (Pa) | 80 | 80 | 80 | 80 | 80 | 80 |

With respect to the electrophotographic photosensitive member which was produced according to example 7, the surface roughness was calculated as in example 2, and thereafter, the carbon atomic ratio, the hydrogen atomic ratio, the Si atomic density, the C atomic density and the Si+C atomic density were obtained as in example 6, and the wear resistance, adhesion, gradation and sensitivity were evaluated. The results are shown in Table 32.

TABLE 32

| | Layer forming condition No. | Surface layer: Carbon atomic ratio | Si atomic density ($10^{22}$ atom/cm$^3$) | C atomic density ($10^{22}$ atom/cm$^3$) | Si + C atomic density ($10^{22}$ atom/cm$^3$) | Hydrogen atomic ratio | Adhesion | Wear resistance | Gradation | Sensitivity |
|---|---|---|---|---|---|---|---|---|---|---|
| Ex. 7 | 35 | 0.59 | 3.12 | 4.49 | 7.61 | 0.32 | A | A | B | A |
| | 36 | 0.61 | 2.99 | 4.68 | 7.67 | 0.31 | A | A | A | A |
| | 37 | 0.65 | 2.68 | 4.99 | 7.67 | 0.31 | A | A | A | A |
| | 38 | 0.73 | 1.85 | 5.02 | 6.87 | 0.40 | A | A | A | A |
| | 39 | 0.75 | 1.79 | 5.37 | 7.16 | 0.36 | A | A | A | A |
| | 40 | 0.76 | 1.68 | 5.31 | 6.99 | 0.39 | A | A | A | B |

The distributions in the layer thickness direction of the carbon atomic ratio and the hydrogen atomic ratio in the intermediate layer of example 7 were the same as those in the layer forming condition No. 3 of example 1, and were distributions similar to FIG. 1A. From the results of Table 32, it has been found out that by setting the carbon atomic ratio at 0.61 or more in addition to setting the Si+C atomic density in the surface layer at $6.60\times10^{22}$ atom/cm$^3$ or more, the gradation becomes favorable. Further, it has been found out that by setting the carbon atomic ratio at 0.75 or less in addition to setting the Si+C atomic density in the surface layer at $6.60\times10^{22}$ atom/cm$^3$ or more, the light absorption is suppressed, and favorable sensitivity is obtained. As for the surface roughness of the electrophotographic photosensitive members produced in example 7, Ra was in the range of 32 nm to 36 nm inclusive, and Δa was in the range of 0.13 to 0.16 inclusive.

Example 8

Similarly to example 6, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the above described Table 28. At this time, the high-frequency power, and the flow rates of $SiH_4$ and $CH_4$ at the time of formation of the surface layer were set as those in the layer forming conditions shown in the following Table 33, and six positively chargeable a-Si photosensitive members were produced under the respective layer forming conditions. Further, the layer thickness of the surface layer was formed by being adjusted to be 2.00 μm for five of the produced electrophotographic photosensitive members, and 0.03 μm for the remaining one.

TABLE 33

| Layer forming condition No. | 41 | 42 | 43 | 44 | 45 | 46 |
|---|---|---|---|---|---|---|
| $SiH_4$ [mL/min (normal)] | 32 | 26 | 26 | 26 | 26 | 26 |
| $CH_4$ [mL/min (normal)] | 260 | 190 | 260 | 360 | 360 | 320 |
| High-frequency power (W) | 850 | 750 | 750 | 650 | 600 | 550 |
| Internal pressure (Pa) | 80 | 80 | 80 | 80 | 80 | 80 |

the time of formation of the surface layer were set as conditions shown in the following Table 34. Further, the layer thickness of the surface layer was formed by being adjusted to be 2.00 μm for five of the produced electrophotographic photosensitive members, and 0.30 μm for the remaining one.

TABLE 34

| Layer forming condition No. | 47 | 48 |
|---|---|---|
| $SiH_4$ [mL/min (normal)] | 26 | 26 |
| $CH_4$ [mL/min (normal)] | 260 | 400 |
| High-frequency power (W) | 850 | 650 |
| Internal pressure (Pa) | 80 | 80 |

With respect to the electrophotographic photosensitive member which was produced according to comparative example 5, the surface roughness was calculated as in example 2, thereafter, the carbon atomic ratio, the hydrogen atomic ratio, the Si atomic density, the C atomic density and the Si+C atomic density were obtained as in example 6, and the wear resistance, adhesion, gradation and sensitivity were evaluated. The results are shown in Table 35. The measurement results and the evaluation results in example 8 and comparative example 5 are shown in Table 35.

TABLE 35

| | Layer | Surface layer | | | | | | | | |
|---|---|---|---|---|---|---|---|---|---|---|
| | forming condition No. | Carbon atomic ratio | Si atomic density ($10^{22}$ atom/cm$^3$) | C atomic density ($10^{22}$ atom/cm$^3$) | Si + C atomic density ($10^{22}$ atom/cm$^3$) | Hydrogen atomic ratio | Adhesion | Wear resistance | Gradation | Sensitivity |
| Com. Ex. 5 | 47 | 0.71 | 2.19 | 5.37 | 7.56 | 0.29 | A | A | C | B |
| Ex. 8 | 41 | 0.67 | 2.48 | 5.04 | 7.52 | 0.30 | A | A | C | A |
| | 42 | 0.67 | 2.55 | 5.18 | 7.73 | 0.30 | A | A | C | A |
| | 43 | 0.70 | 2.23 | 5.20 | 7.43 | 0.33 | A | A | C | A |
| | 44 | 0.71 | 1.96 | 4.81 | 6.77 | 0.42 | A | C | C | A |
| | 45 | 0.70 | 2.00 | 4.66 | 6.65 | 0.44 | A | C | C | A |
| | 46 | 0.68 | 2.14 | 4.54 | 6.68 | 0.45 | A | C | C | A |
| Com. Ex. 5 | 48 | 0.72 | 1.86 | 4.77 | 6.63 | 0.46 | A | D | C | A |

With respect to the electrophotographic photosensitive member which was produced according to example 8, the surface roughness was calculated as in example 2, thereafter, the carbon atomic ratio, the hydrogen atomic ratio, the Si atomic density, the C atomic density and the Si+C atomic density were obtained as in example 6, and the wear resistance, adhesion, gradation and sensitivity were evaluated. The results are shown in Table 35.

Comparative Example 5

Similarly to example 8, a plasma processing apparatus using a high-frequency power supply in an RF band as a frequency illustrated in FIG. 3 was used, and the charge injection inhibition layer, the photoconductive layer, the intermediate layer and the surface layer were formed in sequence on the cylindrical substrate in the conditions shown in the above described Table 28, and six positively chargeable a-Si photosensitive members were produced. At this time, the high-frequency power and the flow rates of $SiH_4$ and $CH_4$ at The distributions in the layer thickness direction of the carbon atomic ratio and the hydrogen atomic ratio in the intermediate layer of example 8 were the same as those in the layer forming condition No. 3 of example 1, and were distributions similar to FIG. 1A. From the results of Table 35, it has been found out that by setting the hydrogen atomic ratio in the surface layer at 0.30 or more, light absorption is suppressed, and favorable sensitivity is obtained. Further, it has been found out that by setting the hydrogen atomic ratio in the surface layer at 0.45 or less, more favorable wear resistance is obtained. As for the surface roughness of the electrophotographic photosensitive members produced in example 8, Ra was in the range of 32 nm to 36 nm inclusive, and Δa was in the range of 0.13 to 0.16 inclusive.

In the above examples, it could be confirmed that the layer thickness of the surface layer measured with the spectroscopic ellipsometry was the same as the layer thickness of the surface layer measured with the FIB and the TEM.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-269346, filed Nov. 26, 2009, and No. 2010-254811, filed Nov. 15, 2010 which are hereby incorporated by reference herein in their entirety.

What is claimed is:

1. An electrophotographic photosensitive member comprising a substrate, a photoconductive layer on the substrate, an intermediate layer on the photoconductive layer, and a surface layer formed from hydrogenated amorphous silicon carbide on the intermediate layer, wherein the intermediate layer contains silicon atoms, carbon atoms, and hydrogen atoms, a distribution of a hydrogen atomic ratio, which is defined by a ratio (H/(Si+C+H)) of the number of hydrogen atoms (H) to a sum of the number of silicon atoms (Si), the number of carbon atoms (C), and the number of hydrogen atoms (H), in the intermediate layer has a maximum region in a layer thickness direction of the intermediate layer, a largest value of the hydrogen atomic ratio in the maximum region of the distribution of the hydrogen atomic ratio in the intermediate layer is larger than a hydrogen atomic ratio in the surface layer, the hydrogen atomic ratio in the surface layer is 0.30 to 0.45 inclusive, a distribution of a carbon atomic ratio, which is defined by a ratio (C/(Si+C)) of the number of carbon atoms (C) to a sum of the number of silicon atoms (Si) and the number of carbon atoms (C), in the intermediate layer has a maximum region and a minimum region in the layer thickness direction of the intermediate layer, a carbon atomic ratio in the maximum region of the distribution of the carbon atomic ratio in the intermediate layer is 0.53 to 0.63 inclusive, a carbon atomic ratio in the minimum region of the distribution of the carbon atomic ratio in the intermediate layer is 0.47 or more, and is smaller than the carbon atomic ratio in the maximum region of the distribution of the carbon atomic ratio in the intermediate layer, and at least a part of the maximum region of the hydrogen atomic ratio in the intermediate layer is superimposed on the minimum region of the carbon atomic ratio in the intermediate layer.

2. The electrophotographic photosensitive member according to claim 1, wherein when a largest value of the carbon atomic ratio in the maximum region of the distribution of the carbon atomic ratio in the intermediate layer is set as C1, a hydrogen atomic ratio at a position where the carbon atomic ratio in the maximum region of the distribution of the carbon atomic ratio in the intermediate layer becomes the largest value is set as H1, a smallest value of the carbon atomic ratio in the minimum region of the distribution of the carbon atomic ratio in the intermediate layer is set as C2, and the largest value of the hydrogen atomic ratio in the maximum region of the distribution of the hydrogen atomic ratio is set as H2, the following expressions 1 and 2 are satisfied:

$$-0.06 \leqq C2 - C1 \leqq -0.01 \quad \text{(Expression 1)}$$

$$0.05 \leqq H2 - H1 \leqq 0.15 \quad \text{(Expression 2).}$$

3. The electrophotographic photosensitive member according to claim 1, wherein the largest value of the hydrogen atomic ratio in the maximum region of the distribution of the hydrogen atomic ratio in the intermediate layer is 0.50 or less.

4. The electrophotographic photosensitive member according to claim 1, wherein a distance d2 from the maximum region of the distribution of the carbon atomic ratio in the intermediate layer to the surface layer is 300 angstroms to 5000 angstroms inclusive.

5. The electrophotographic photosensitive member according to claim 1, wherein in the intermediate layer, a ratio (d2/s1) of the distance d2 from the maximum region of the distribution of the carbon atomic ratio in the intermediate layer to the surface layer, to a layer thickness d1 of the surface layer is 0.05 or more.

6. The electrophotographic photosensitive member according to claim 1, wherein the carbon atomic ratio in the surface layer is 0.61 to 0.75 inclusive, and a sum of an atomic density of silicon atoms and an atomic density of carbon atoms is 6.60×1022 atom/cm3 or more.

7. The electrophotographic photosensitive member according to claim 1, wherein the photoconductive layer comprises hydrogenated amorphous silicon.

8. An electrophotographic apparatus comprising the electrophotographic photosensitive member according to claim 1.

* * * * *